US009733041B2

(12) United States Patent
Khoshnood

(10) Patent No.: US 9,733,041 B2
(45) Date of Patent: Aug. 15, 2017

(54) DISARM MECHANISM FOR A CROSSBOW TRIGGER

(71) Applicant: Bahram Khoshnood, Alpharetta, GA (US)

(72) Inventor: Bahram Khoshnood, Alpharetta, GA (US)

( * ) Notice: Subject to any disclaimer, the term of this patent is extended or adjusted under 35 U.S.C. 154(b) by 0 days.

(21) Appl. No.: 14/957,226

(22) Filed: Dec. 2, 2015

(65) Prior Publication Data

US 2017/0160044 A1 Jun. 8, 2017

(51) Int. Cl.

| | |
|---|---|
| ***F41B 5/12*** | (2006.01) |
| ***F41A 19/10*** | (2006.01) |
| ***F41A 17/00*** | (2006.01) |
| ***F41B 5/14*** | (2006.01) |
| ***F41A 17/46*** | (2006.01) |

(52) U.S. Cl.
CPC ..... *F41B 5/1469* (2013.01); *F41A 17/46* (2013.01); *F41B 5/12* (2013.01)

(58) Field of Classification Search
CPC ..... F41B 5/12; F41B 5/1469; F41A 17/46; F41A 17/48; F41A 19/10
USPC ..... 124/25, 35.1, 40, 31
See application file for complete search history.

(56) References Cited

U.S. PATENT DOCUMENTS 5,243,956 A * 9/1993 Luehring ..... F41B 5/12 124/25
5,598,829 A * 2/1997 Bednar ..... F41A 17/28 124/25
5,649,520 A * 7/1997 Bednar ..... F41B 5/12 124/25
6,736,123 B1 * 5/2004 Summers ..... F41A 17/46 124/25
7,588,022 B2 * 9/2009 Chang ..... F41B 5/123 124/25
7,770,567 B1 * 8/2010 Yehle ..... F41A 17/46 124/25
8,091,540 B2 * 1/2012 Matasic ..... F41B 5/12 124/25
8,522,761 B1 * 9/2013 Chu ..... F41A 17/46 124/25
8,651,094 B2 * 2/2014 Matasic ..... F41B 5/12 124/23.1
9,004,053 B1 * 4/2015 Anderson ..... F41B 5/1469 124/31

(Continued)

*Primary Examiner* — Alexander Niconovich
(74) *Attorney, Agent, or Firm* — Brient Globerman, LLC; Kyle M. Globerman

(57) ABSTRACT

A trigger mechanism for use in a crossbow having a bowstring, the trigger mechanism comprising a housing, a trigger lever at least partially received in the housing and pivotally mounted thereto, a sliding block comprising a recess formed in a first surface, and a bowstring catch pivotally mounted in the housing. The bowstring catch has a first end configured to retain the bowstring in the housing when the crossbow is in a cocked position, and a second end that is configured to engage with the trigger lever. The sliding block is moveable between a safety on first position that prevents the trigger lever from rotating, a safety off second position where the trigger lever may be rotated, and a disarm position where a second arm of the trigger lever is partially received in the sliding block recess and a first arm of the trigger lever disengages from the bowstring catch.

20 Claims, 22 Drawing Sheets

(56) References Cited

U.S. PATENT DOCUMENTS

| | | | | |
|---|---|---|---|---|
| 9,010,308 | B1 * | 4/2015 | Hyde | F41B 5/1469 124/25 |
| 9,404,701 | B2 * | 8/2016 | Lipowski | F41B 5/12 |
| 9,404,705 | B2 * | 8/2016 | Kennedy | F41B 5/12 |
| 9,435,605 | B2 * | 9/2016 | McPherson | F41A 17/46 |
| 9,506,715 | B2 * | 11/2016 | Hughes | F41A 19/10 |
| 2014/0182574 | A1 * | 7/2014 | Darlington | F41B 5/1403 124/35.1 |
| 2014/0246003 | A1 * | 9/2014 | Lipowski | F41A 17/46 124/25 |
| 2015/0144117 | A1 * | 5/2015 | Khoshnood | F41B 5/10 124/25 |
| 2015/0260477 | A1 * | 9/2015 | Khoshnood | F41B 5/12 124/25 |

* cited by examiner

DISARM MECHANISM FOR A CROSSBOW TRIGGER

BACKGROUND

The present invention relates generally to crossbows and in particular to an improved release mechanism for cocking and un-cocking a crossbow.

Crossbows have been used since the Middle Ages. Crossbows have evolved to include cams and synthetic split limbs that greatly increase firing velocity. However, increased firing velocity creates a problem when a crossbow is dry-fired in order to release the bowstring from a cocked position into an un-cocked position without firing a bolt or arrow. Unloaded or dry firing impacts can damage the bowstring, limbs, cams and other components. Dry firing also creates a safety concern.

SUMMARY

In one embodiment, a crossbow and trigger mechanism comprises: (1) a body having a first end and a second end; (2) a first limb comprising a first end coupled to the body first end and a second end; (3) a second limb comprising a first end coupled to the body first end and a second end; (4) a bowstring having a bowstring first end coupled to the first limb second end and a bowstring second end coupled to the second limb second end; and (5) a trigger mechanism operatively coupled to the body intermediate the body first end and the body second end. The trigger mechanism comprises: (1) a housing comprising a first side defining a slot there through and an opposite side having a first recess formed therein; (2) a trigger lever at least partially received in the housing and pivotally mounted to the housing, the trigger lever comprising: (a) a trigger that partially extends from the housing; (b) a trigger first arm; and (c) a trigger second arm; (3) a sliding block comprising a recess formed in a first surface; (4) a bolt having a first end operatively coupled to a second surface of the sliding block and a second end that is at least partially positioned in the housing first recess; and (5) a bowstring catch pivotally mounted in the housing, the bowstring catch having a first end configured to retain the bowstring in the housing slot when the crossbow is in a cocked position and a second end that is configured to engage with the trigger first arm when the crossbow is in the cocked position. The sliding block is moveable between: (1) a safety on first position in which the sliding block first surface abuts the trigger lever second arm thereby preventing the trigger lever from rotating so that the trigger first arm can disengage from the bowstring catch second end; (2) a safety off second position in which the sliding block first surface is moved out of engagement with the trigger second arm thereby allowing a user to depress the trigger thereby causing the trigger lever to rotate into a fired position where the trigger first arm disengages from the bowstring catch second end causing the bowstring to exit the housing slot; and (3) a disarm position in which the sliding block recess aligns with the trigger second arm so that when the trigger lever rotates: (a) the trigger second arm is partially received in the sliding block recess; and (b) the trigger first arm disengages from the bowstring catch second end thereby allowing the bowstring to be released from the housing slot without the user firing the crossbow.

In general, in various embodiments, a crossbow and trigger mechanism comprising: (1) a body having a first end and a second end; (2) a first limb comprising a first end coupled to the body first end and a second end; (3) a second limb comprising a first end coupled to the body first end and a second end; (4) a bowstring having a bowstring first end coupled to the first limb second end and a bowstring second end coupled to the second limb second end; and (5) a trigger mechanism operatively coupled to the body intermediate the body first end and the body second end. The trigger mechanism comprises: (1) a trigger lever pivotally coupled to the body, the trigger lever comprising: (a) a trigger that partially extends from the body; (b) a trigger first arm; and (c) a trigger second arm; (2) a sliding block that is slidably mounted at least partially within the body; (3) a lever pivotally mounted at least partially in the body, the lever comprising a first end and a second end that is operatively coupled to the body by a spring; and (4) a bowstring catch pivotally mounted at least partially in the body, the bowstring catch having a first end configured to retain the bowstring in the housing slot when the crossbow is in a cocked position and a second end that is configured to engage with the trigger first arm when the crossbow is in the cocked position. When the sliding block is moved into a disarm position: (1) the sliding block engages with the lever first end thereby causing the lever to rotate; (2) the lever second end engages with the trigger second arm causing trigger to rotate; and (3) the trigger first arm moves out of engagement with the bowstring catch second end, thereby allowing the bowstring catch to rotate so that the bowstring is released from the trigger mechanism.

According to various embodiments, a crossbow and trigger mechanism comprising: (1) a body having a first end and a second end; (2) a first limb comprising a first end coupled to the body first end and a second end; (3) a second limb comprising a first end coupled to the body first end and a second end; (4) a bowstring having a bowstring first end coupled to the first limb second end and a bowstring second end coupled to the second limb second end; and (5) a trigger mechanism operatively coupled to the body intermediate the body first end and the body second end. The trigger mechanism comprises: (1) a housing comprising a first side defining a slot therethrough and an opposite side having a first recess formed therein; (2) a trigger lever at least partially received in the housing and pivotally mounted to the housing, the trigger lever comprising: (a) a trigger that partially extends from the housing; (b) a trigger first arm; and (c) a trigger second arm; (3) a sliding block having a first surface; (4) a bolt having a first end operatively coupled to a second surface of the sliding block and a second end that is at least partially positioned in the housing first recess; (5) a level having a first end and a second end; and (6) a bowstring catch pivotally mounted in the housing, the bowstring catch having a first end configured to retain the bowstring in the housing slot when the crossbow is in a cocked position and a second end that is configured to engage with the trigger first arm when the crossbow is in the cocked position. The sliding block is moveable between: (1) a firing position in which the in which a user can depress the trigger thereby causing the trigger lever to rotate into a fired position where the trigger first arm disengages from the bowstring catch second end causing the bowstring to exit the housing slot, and (2) a disarm position in which the sliding block engages with the lever first end so that the lever second end engages with the trigger second arm causing: (a) the trigger lever to rotate, and (b) the trigger first arm to disengage from the bowstring catch second end thereby allowing the bowstring to be released from the housing slot without the user firing the crossbow or engaging the trigger with one of the user's hands.

BRIEF DESCRIPTION OF THE DRAWINGS

Having described various embodiments in general terms, reference will now be made to the accompanying drawings, which are not necessarily drawn to scale, and wherein.

DETAILED DESCRIPTION OF VARIOUS EMBODIMENTS

Various embodiments will now be described more fully herein with reference to the accompanying drawings, in which various relevant embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Overview

Figure 1:
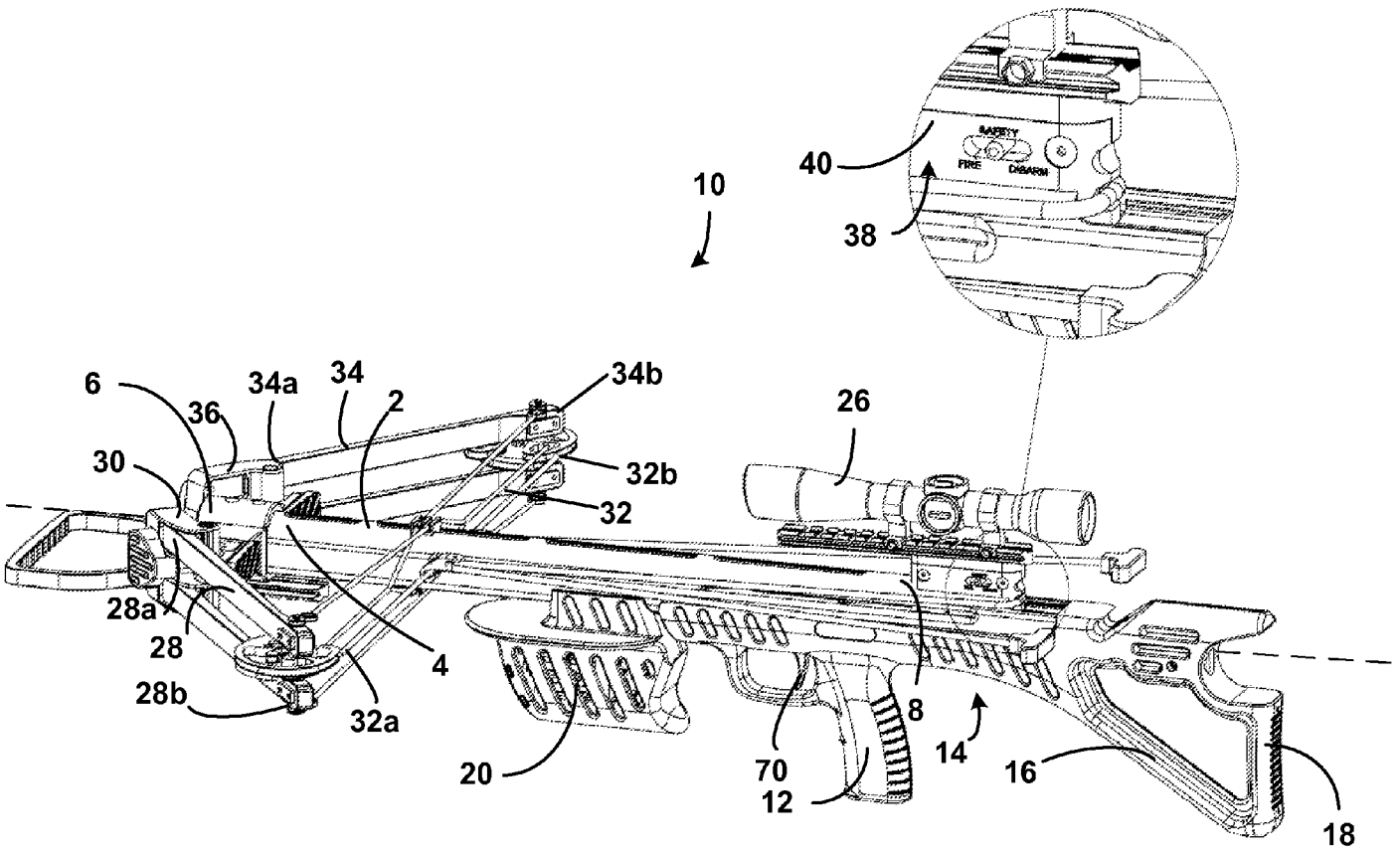
FIG. 1 is a perspective view of an embodiment of a crossbow.

Referring to FIG. 1, a crossbow 10 is shown having a barrel (or body) 2, which has a first end 4 coupled to a riser 6 and a second end 8 coupled to a pistol grip 12, and a stock 14. The barrel 2 has an axis 2*a* that extends from the first end 4 to the second end 8. The stock 14 has a comb 16 and a butt 18. In the embodiment shown, the stock length is adjustable, but in other embodiments the stock 14 may have a fixed length. A grip 20 is coupled to the barrel 2 intermediate the first and second ends 4 and 8. A retention spring 22 is operatively coupled to a top surface 24 of the barrel 2. A scope 26 is also operatively coupled to the barrel top surface 24, which may be optional in various embodiments. A first limb 28 has a first end 28*a* operatively coupled to a left side 30 of the riser 6 and a second end 28*b*. A second limb 34 has a first end 34*a* that is operatively coupled to a right side 36 of the riser and a second end 36*b*. The crossbow 10 includes a bowstring 32 that has a first end 32*a* operatively coupled to the first limb second end 28*b* and a second end 32*b* operatively coupled to the second limb second end 34*b*. The bowstring may be directly coupled to the first and second limbs or it may be operatively coupled to the first and second limbs via a cam system. In various embodiments, the body 2 is comprised of the barrel, the stock 14, the grip 20 and/or the pistol grip 12.

In various embodiments, a trigger mechanism 38 is located within the pistol grip 12 and the barrel 2. In some embodiments, the trigger mechanism 38 is maintained in a housing that is operatively coupled to the barrel 2 and in other embodiments, the trigger mechanism 38 is built directly into the barrel 2 and pistol grip 12. In various embodiments, the trigger mechanism may be sold as a unit that can be installed in a crossbow by the manufacturer or it may be sold as an after market upgrade to replace an original equipment manufacture's (OEM) trigger mechanism. In various embodiments where the trigger mechanism 38 is sold as a replacement, the replacement trigger mechanism may be sold as a kit with instructions on how to replace a trigger mechanism from a standard crossbow. For example, the instructions may direct the user to remove the trigger mechanism and to replace the OEM trigger mechanism with the trigger mechanism described herein. Once the trigger mechanism is replaced, the instructions may further direct the user on how to cock the crossbow, fire the crossbow, and disarm the crossbow, as described herein. Consequently, the trigger mechanism described herein may be installed in a crossbow at the factory, or it may be sold as a replacement trigger mechanism that can be used to replace a stock crossbow trigger mechanism.

In various embodiments, the trigger mechanism is configured to allow a user to move a sliding block within the trigger mechanism into a safety on position, a safety off position (e.g., a firing position), or a disarm position. That is, the sliding block also functions as a safety mechanism. Thus, the user can move the sliding block into the safety on or safety off position using two pins that are coupled to the sliding block and that extend out of a trigger mechanism housing. In order to move the trigger mechanism into a disarm position, using a cocking rope the user pulls the bowstring into the trigger mechanism so that the bowstring engages the sliding block causing the sliding block to move into the disarm position. As the sliding block moves into the disarm position, it operatively causes the trigger lever to automatically rotate without the user directly engaging the trigger to release the bowstring catch. In this way, a user can slowly release the bowstring into an uncocked (e.g., disarm) position without the help of a second user. In other embodiments, the safety mechanism may be a separate mechanism from the sliding block so that the sliding block only moved between a fire position and a disarm position.

Trigger Mechanism Having Integrated Disarm and Safety Mechanism

Figure 2:
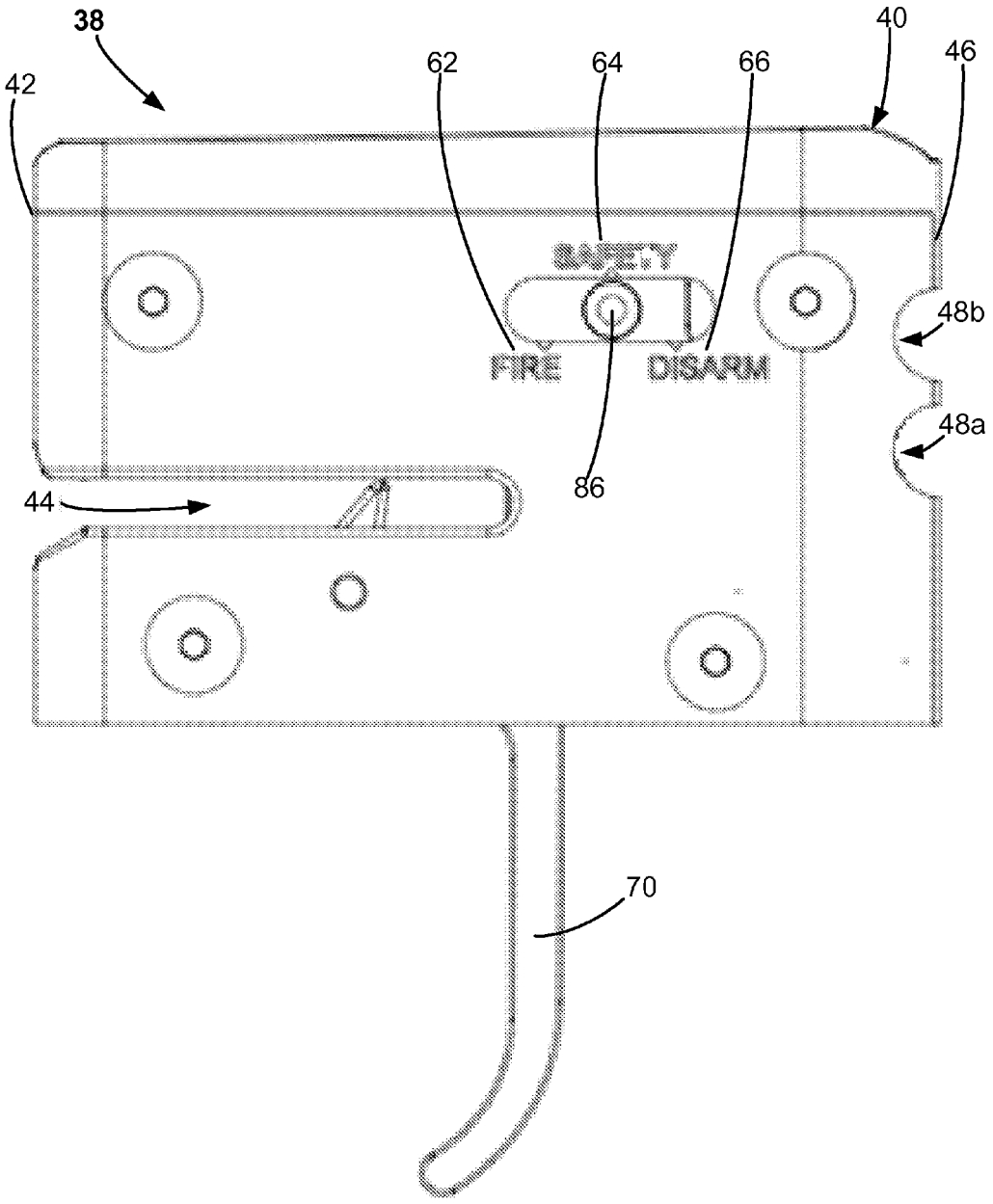
FIG. 2 is a front plan view of an embodiment of a trigger mechanism for use with the crossbow of FIG. 1.
Figure 3:
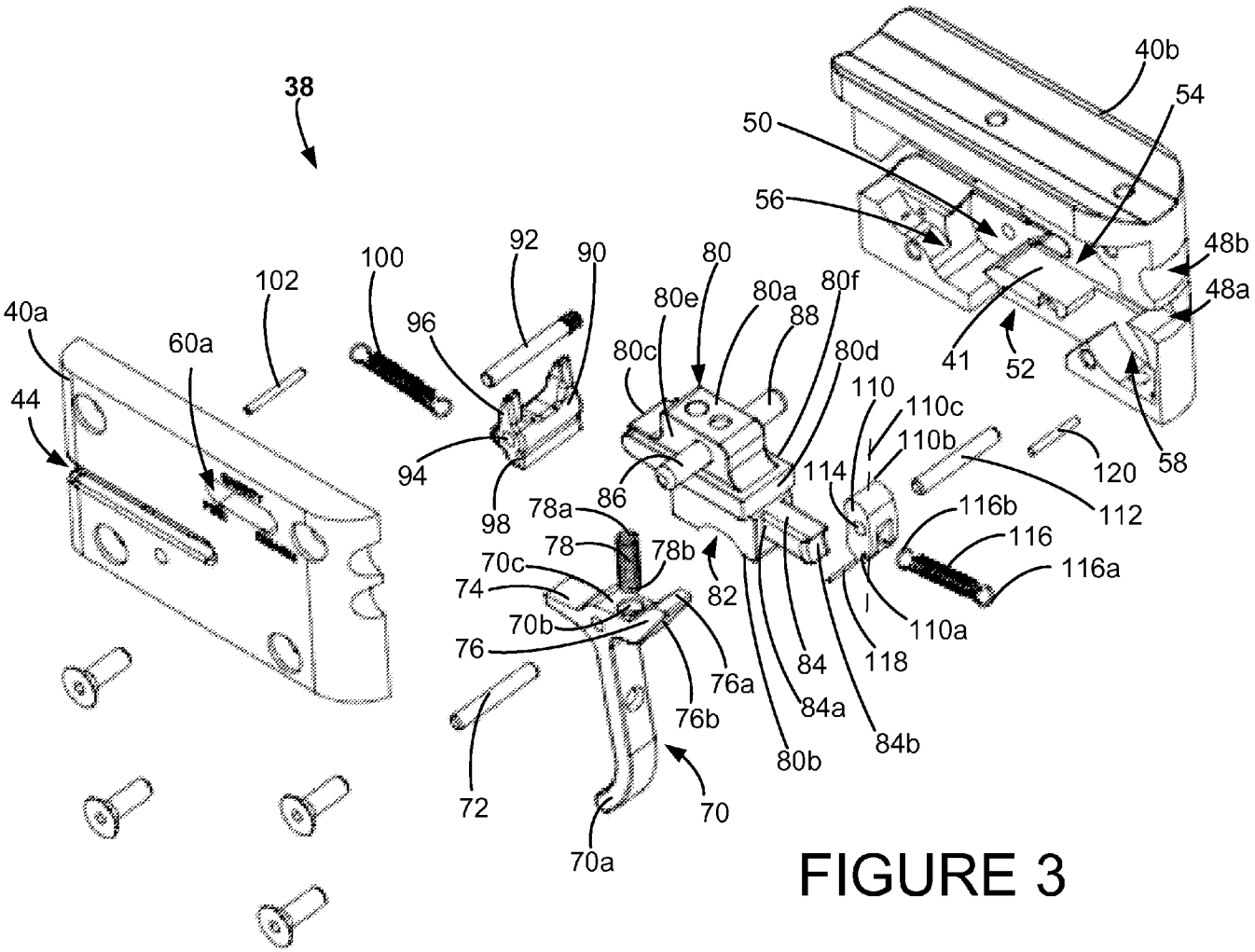
FIG. 3 is an exploded view of the trigger mechanism of FIG. 2.

Referring to FIGS. 2-3, the trigger mechanism 38 has a housing 40, a trigger lever 70, a sliding block 80, bowstring catch 90, and a lever 110, as discussed further below.

Housing

The trigger mechanism 38 contains a two piece housing 40 having a first housing portion 40*a* and a second housing portion 40*b* that together at least partially enclose the various parts of the trigger mechanism 38. The first housing portion 40*a* may be connected to the second housing portion 40*b* using any suitable fastener (e.g., a bolt, a pin, a rivet, weldments, etc.). The housing 40 has a first end 42 (FIG. 2) that defines a slot 44 therethrough and an opposite second end 46 having a first and a second recess 48*a*, 48*b*. The first and second recesses 48*a*, 48*b* are configured for receiving a portion of a cocking rope (not shown). The housing slot 44 is elongated to slidably receive the bowstring 32. The first and second housing portions 40*a*, 40*b* are generally square shaped and formed from aluminum. In various embodiments, the housing 40 may be formed in any shape (e.g., rectangular, polygonal, oval, etc.) and may be formed from any suitable material (e.g., alloy, stainless steel, ceramic, polymers, etc.). In some embodiments, a cavity 50 formed in the housing 40 receives the various parts of the trigger mechanism 38. In various embodiments, the cavity 50 is formed from multiple recessed areas as described herein. In various embodiments, the cavity 50 contains a first recessed area 52 that receives the trigger lever 70, a second recessed area 54 that slidably receives the sliding block 80, a third recessed area 56 that receives the catch 90, and a fourth recessed area 58 that receives the lever 110. It should be understood that the first housing portion 40*a* contains corresponding recesses that align with their respective recesses formed in second housing portion 40*b*.

In various embodiments, each housing portion 40*a* and 40*b* contains a first elongated slot 60*a* (FIG. 3) and a second elongated slot 60*b* (not shown) that open into the cavity 50 and are configured to slidably receive therethrough respective pins 86 and 88 that are formed on a sliding block 80, as discussed further below. Referring particularly to FIG. 2, the elongated slots 60*a*, 60*b* allow the sliding block 80 to be slidable between a safety off first position 62, a safety on second position 64, and a disarm position 66.

Trigger

Referring once more to FIG. 3, the trigger mechanism 38 contains the trigger lever 70, which extends (completely, partially, or not at all) from the bottom of the housing 40 and into the pistol grip 12 (FIG. 1). The trigger lever 70 is pivotally mounted to the housing 40 via a trigger pin 72. In particular embodiments, the trigger lever 70 includes a trigger 70*a*, a first trigger arm 74 and a second trigger arm 76. The trigger first arm 74 operatively engages with the bowstring catch 90. The second trigger arm 76 has a first surface 76*a* that operatively engages with the sliding block 80 and a second surface 76*b* that operatively engages with the lever 110.

The trigger lever 70 is operatively coupled to a spring 78 that has a first end 78*a* that engages an inside wall 41 of the second housing portion 40*b*, and a second end 78*b* that is received in a hole 70*b* formed in a top surface 70*c* of the trigger lever 70. In this configuration, the spring 78 biases the trigger lever 70 clockwise with reference to FIG. 3.

Sliding Block

The trigger mechanism 38 also includes a sliding block 80. The sliding block 80 has a top surface 80*a*, a bottom surface 80*b*, a front surface 80*c*, a back surface 80*d*, a left side surface 80*e*, and a right side surface 80*f*. In various embodiments, the sliding block 80 includes a recess 82 formed in the bottom surface 80*b*. The sliding block 80 also includes a bolt 84 having a first end 84*a* operatively coupled to the sliding block back surface 80*d* and a second end 84*b* that is at least partially positioned in the housing first recess 48*a*. The bolt second end 84*b* is substantially U-shaped and is configured to receive a portion of the cocking rope (shown in FIG. 5). The sliding block 80 includes a first pin 86 operatively coupled to the sliding block left side surface 80*e* and second pin 88 operatively coupled to the sliding block right side surface 80*f*. The first and second pins 86, 88 allow the sliding block 80 to be slidable within the housing elongated slots 60*a*, 60*b* between the safety off first position 62, the safety on second position 64, and the disarm position 66.

Bowstring Catch

In various embodiments, the trigger mechanism 38 has a bowstring catch 90 pivotally mounted in the housing 40 via a first bowstring catch pin 92 that is received in a hole 94 formed through the bowstring catch 90. The bowstring catch 90 has a first end 96 configured to retain the bowstring 32 in the housing slot 44 when the crossbow 10 is in a cocked position. The bowstring catch first end 96 is "U" shaped. The "U" shaped end allows a bolt (not shown) to be knocked on the bowstring 32 (FIG. 1) without interfering with the bolt when the bowstring 32 is drawn into the cocked position. The bowstring catch 90 also has a second end 98 that is configured to engage with the trigger first arm 74 when the crossbow 10 is in the cocked position. A first spring 100, operatively coupled to the bowstring catch 90 via a second bowstring catch pin 102, biases the bowstring catch second end 98 in a clockwise direction with reference to FIG. 3.

Lever

Adjacent the trigger second arm 76 is a lever 110. The lever has a first end 110*a* and a second end 110*b* and an axis 110*c* that extends between the first end 110*a* and the second end 110*b*. The lever 110 is pivotally mounted in the housing 40 via a first lever pin 112 that is received in a hole 114 formed through the lever 110 intermediate the lever first end 110*a* and second end 110*b*. The lever 110 is operatively coupled to a tension spring 116, having a first end 116*a* and a second end 116*b*, such that the tension spring first end 116*a* is operatively coupled to the housing 40 and the tension spring second end 116*b* is operatively coupled to the lever 110 proximate the lever first end 110*a* via a second lever pin 118. The tension spring 116 biases the lever 110 into a counterclockwise rotation with reference to FIG. 3. Proximate the lever first end 110*a* is a stop 120, which prevents the tension spring 116 from continuing to rotate the lever 110 in the counterclockwise direction.

Exemplary Trigger Mechanism Operation

FIGS. 4-8 show an exemplary trigger mechanism 38. While trigger mechanisms exist in many guns and weapons, in this exemplary embodiment, the trigger mechanism 38 provides a release mechanism that allows a user to release a cocked crossbow without having to dry fire the weapon or engage the trigger with the user's hand. That is, the user does not have to activate the trigger to un-cock the crossbow.

Cocking the Crossbow

Figure 4:
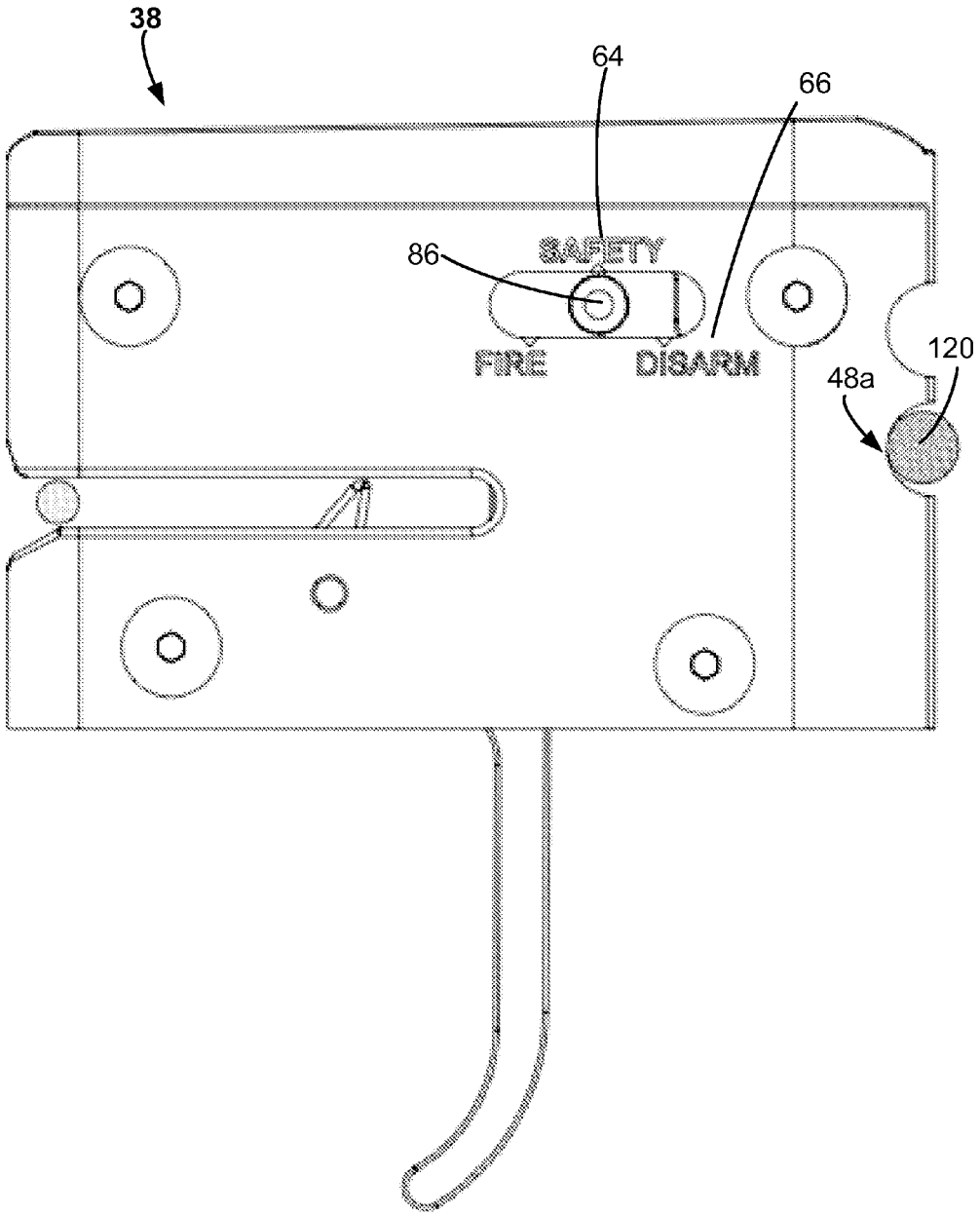
FIG. 4 is a front plan view of the embodiment of the trigger mechanism of FIG. 2, with the safety in a safety-on position.
Figure 5:
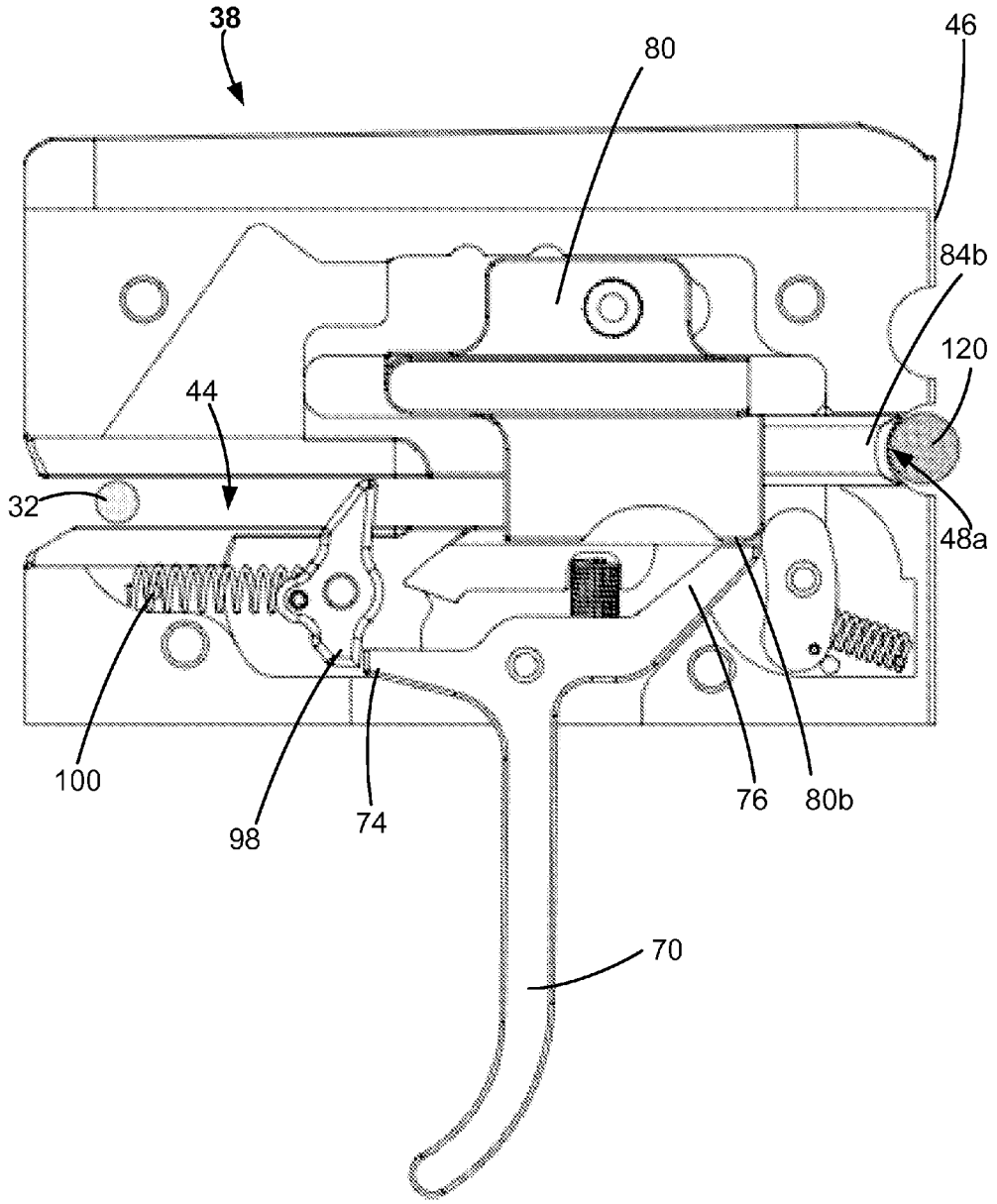
FIG. 5 is a partial sectional view of the trigger mechanism of FIG. 2, in a first position.

Specifically referring to FIG. 4, the trigger mechanism 38 is shown with the sliding block first pin 86 in the safety on second position 64. A cocking rope 120 has been inserted into the housing first recess 48*a* and attached at the opposite end (not shown) to the bowstring 32. Referring to FIG. 5, the trigger mechanism 38 of FIG. 4 is shown with the housing first portion 40*a* removed. In the present configuration, the cocking rope 120 is engaged in the housing first recess 48*a*. Because the cocking rope 120 abuts against the bolt second end 84*b*, the sliding block 80 is prevented from moving into the disarm position 66. The bowstring 32 is shown positioned just inside the opening of slot 44 as the user is moving the bowstring 32 into a cocked position. The first spring 100 biases the bowstring catch 90 toward the housing second end 46 until the bowstring catch second end 98 abuts the trigger first arm 74. The sliding block bottom surface 80*b* abuts the trigger second arm 76 thereby preventing the trigger lever 70 from rotating in the counterclockwise direction, with respect to FIG. 5. That is, the sliding block 80 also functions as a safety mechanism.

Figure 6:
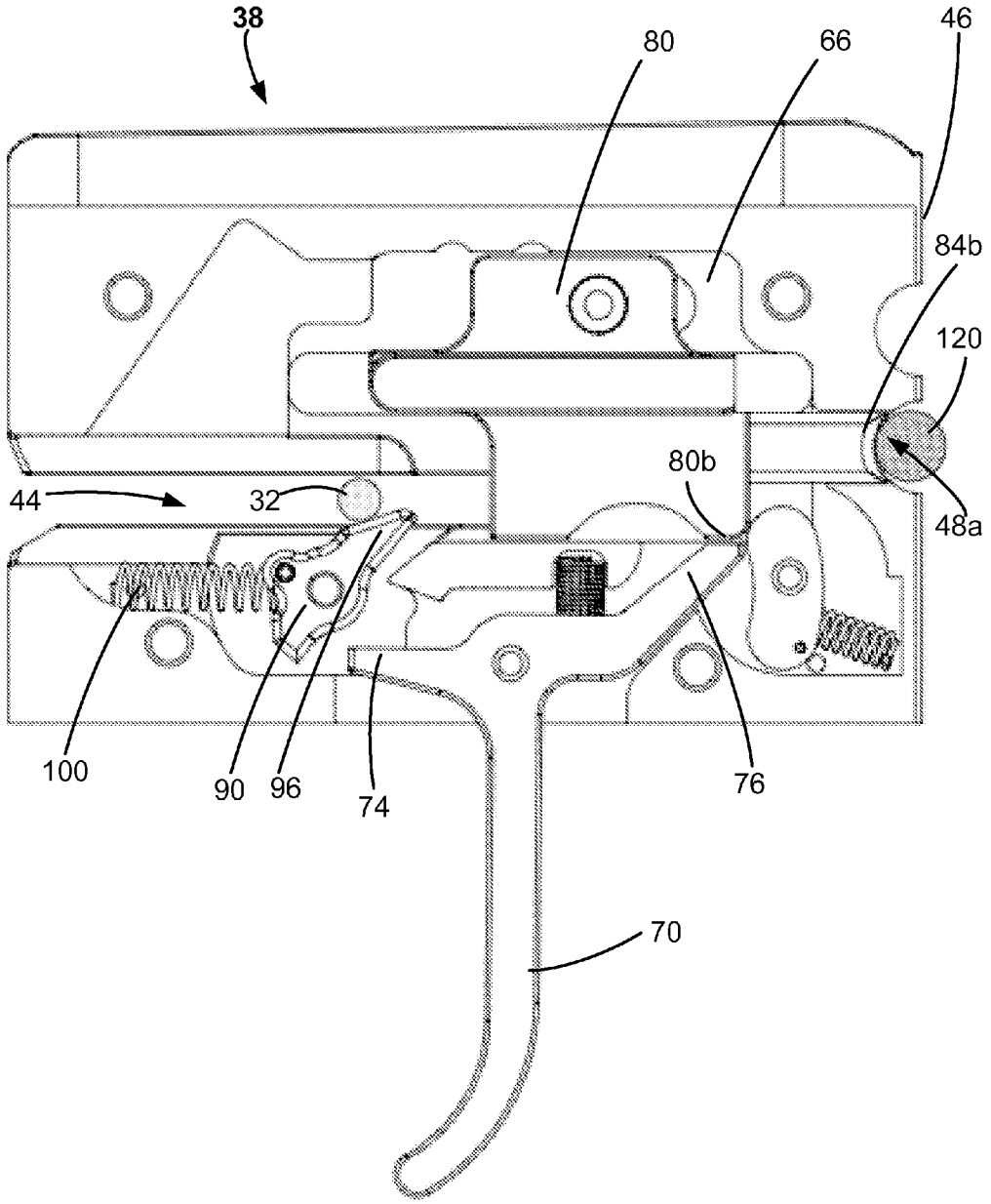
FIG. 6 is a partial sectional view of the trigger mechanism of FIG. 2, in a second position.

Referring to FIG. 6 as the bowstring 32 is moved further into slot 44, the knocked bowstring 32 pushes against the bowstring catch first end 96 causing the bowstring catch 90 to rotate clockwise allowing the bowstring 32 to pass over the bowstring catch 90. The sliding block 80 is maintained in the safety on position since the cocking rope 120 abuts the bolt first end 84*b*. Moreover, in the safety on position, the trigger second arm 76 abuts the sliding block bottom surface 80*b* thereby preventing the trigger lever from rotating.

Figure 7:
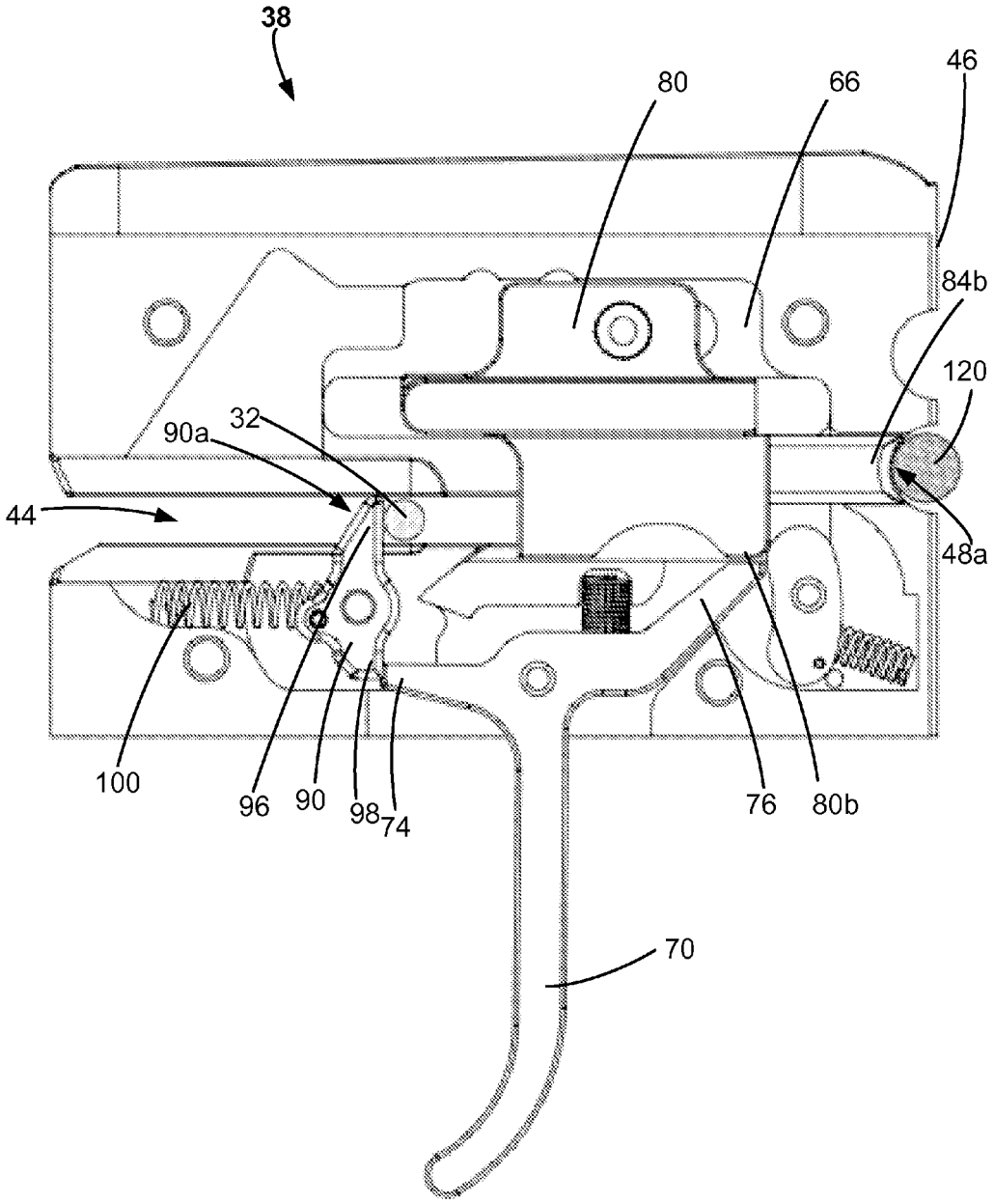
FIG. 7 is a partial sectional view of the trigger mechanism of FIG. 2, in a third position.
Figure 8:
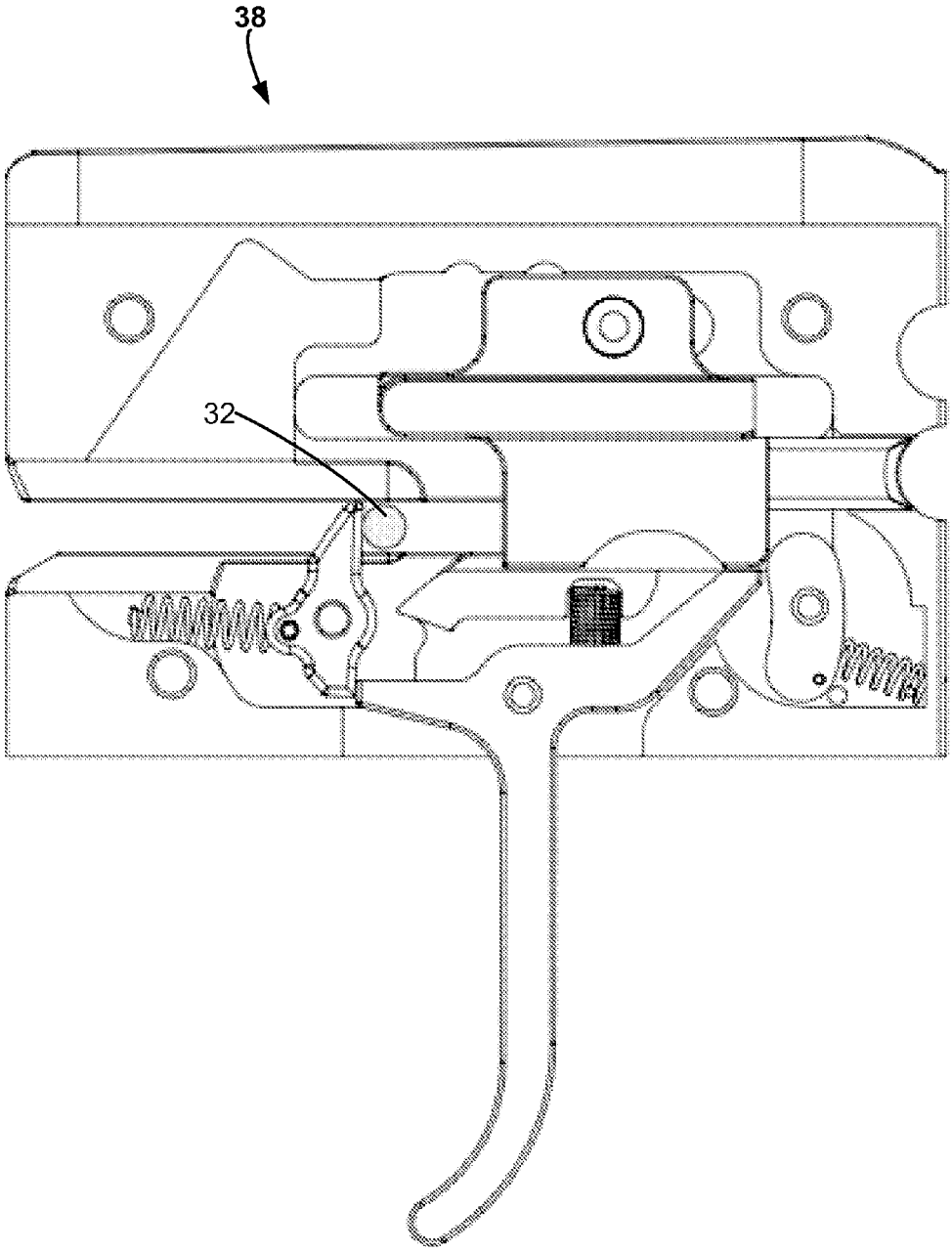
FIG. 8 is a partial sectional view of the trigger mechanism of FIG. 2, in a fourth position.
Figure 9:
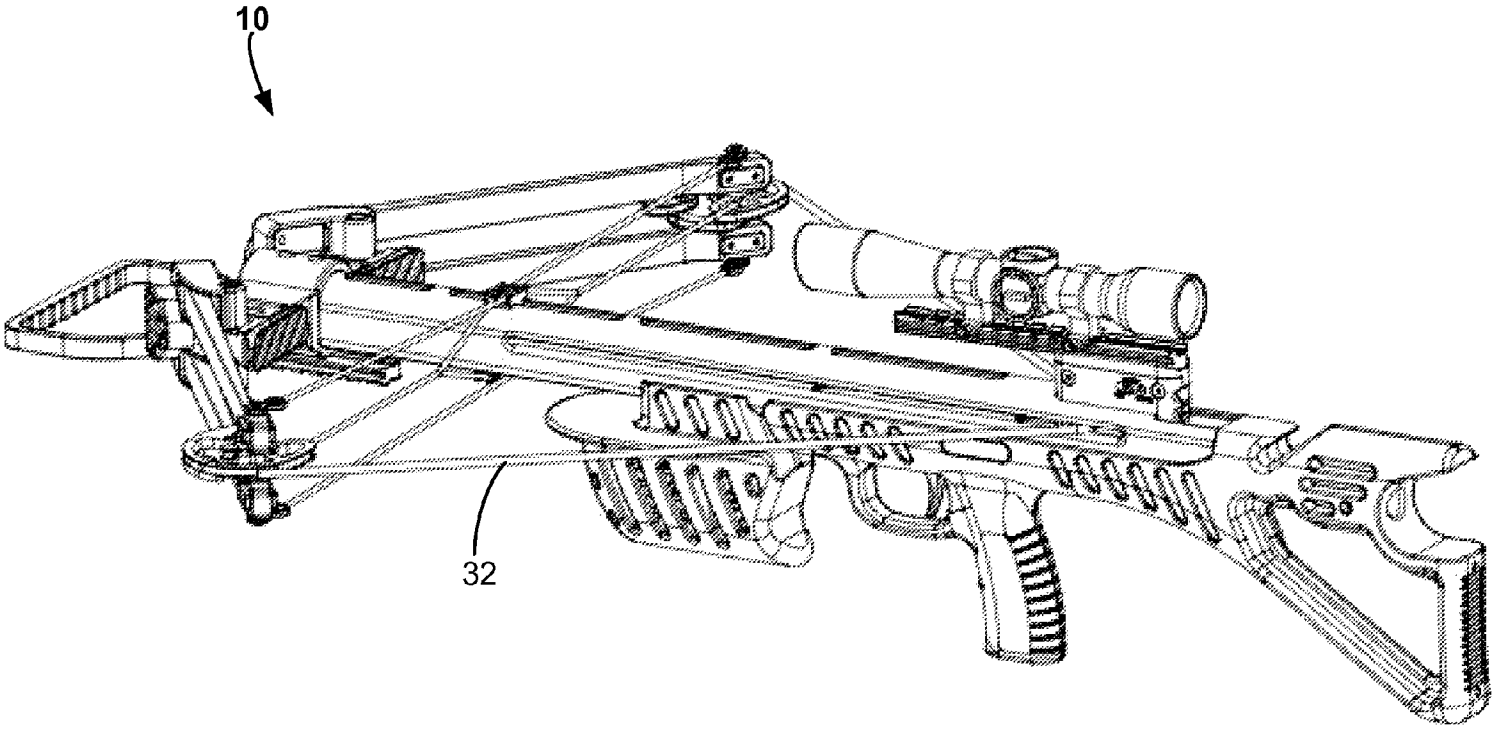
FIG. 9 is a perspective view of the crossbow of FIG. 1 in a cocked position.

Referring to FIG. 7, once the bowstring 32 passes the bowstring catch 90, the first spring 100 causes the bowstring catch 90 to rotate in the counterclockwise direction until the trigger first arm 74 abuts against the bowstring catch second end 98, preventing further rotation of the bowstring catch 90. This causes the bowstring catch 90 to be in an upright position 90*a* such that the bowstring catch first end 96 is located above and substantially in line with the bowstring catch second end 98. With the bowstring catch 90 in the upright position 90*a*, the bowstring catch first end 96 prevents the bowstring 32 from sliding out of the slot 44. Referring to FIGS. 8 and 9, with the bowstring 32 in the cocked position, the cocking rope may be removed.

Firing the Crossbow

Figure 10:
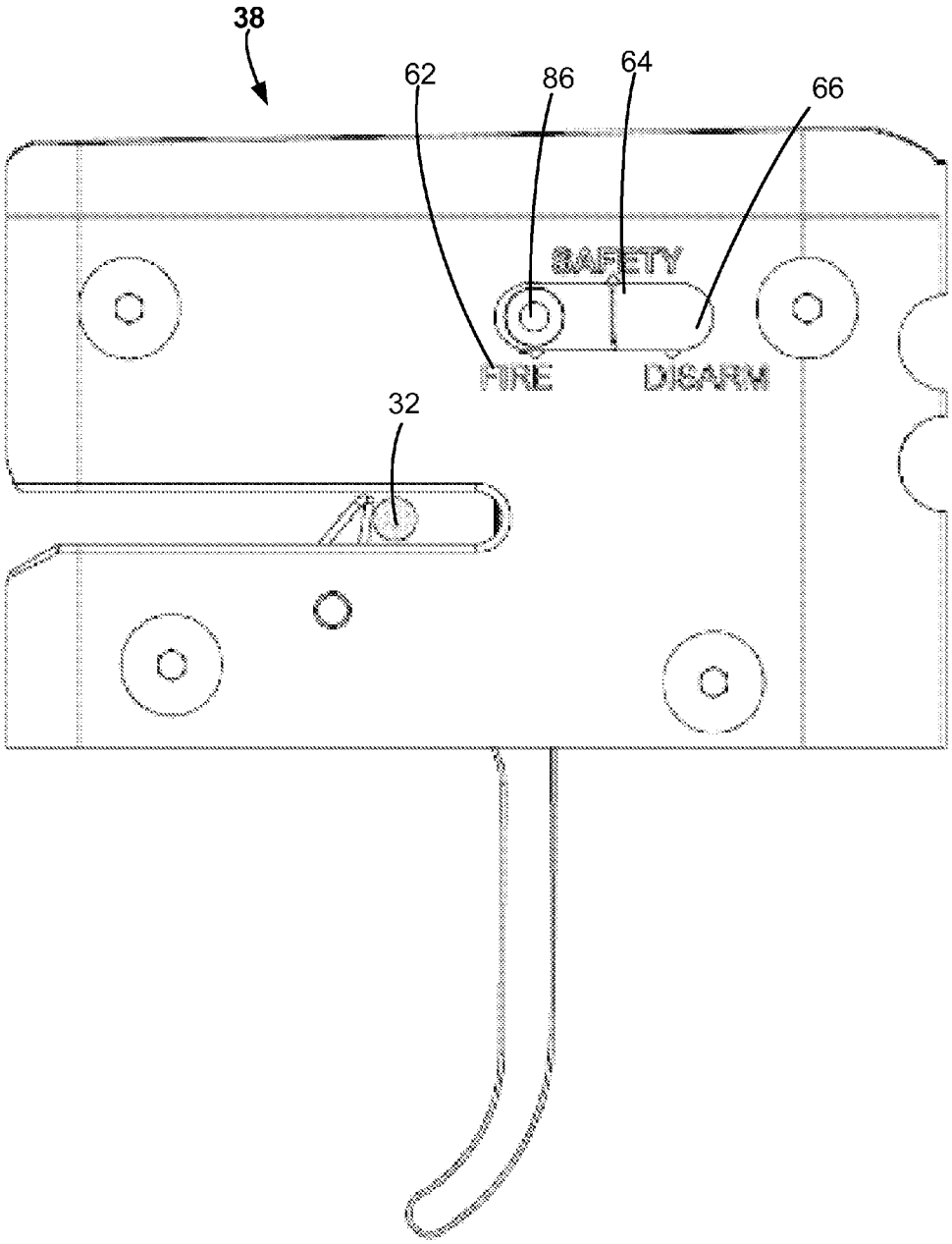
FIG. 10 is a front plan view of the embodiment of the trigger mechanism of FIG. 2, with the safety in a fire position.
Figure 11:
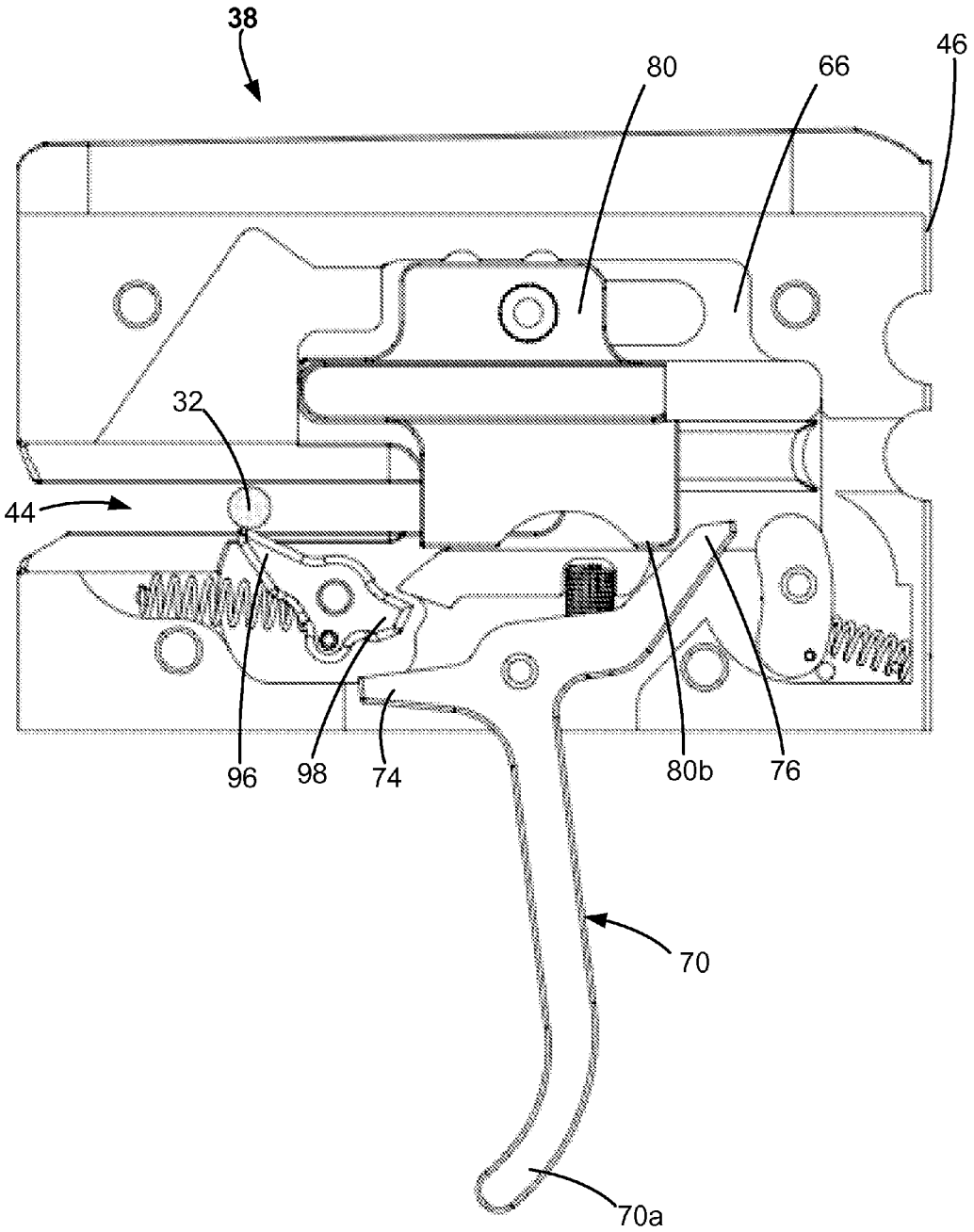
FIG. 11 is a partial sectional view of the trigger mechanism of FIG. 2, in a fifth position.

Referring to FIG. 10, with the cocking rope removed and the bowstring 32 in the cocked position, the sliding block first pin 86 may be moved from the safety position 64 (FIG. 4) into the safety off ("fire") position 62, as shown. Referring to FIG. 11, with the sliding block 80 in the safety off first position 62, the sliding block bottom surface 80*b* is moved to the right and no longer abuts the trigger second arm 76 so that the trigger 70*a* may be pulled to rotate the trigger lever 70 in the counterclockwise direction with respect to FIG. 11. When the trigger lever 70 rotates in the counterclockwise direction, the trigger first arm 74 moves out of engagement with the bowstring catch second end 98 thereby causing the force of the bowstring 32 pushing against the bowstring catch first end 96 to cause the bowstring 32 to exit the slot 44.

Uncocking the Crossbow

Figure 12:
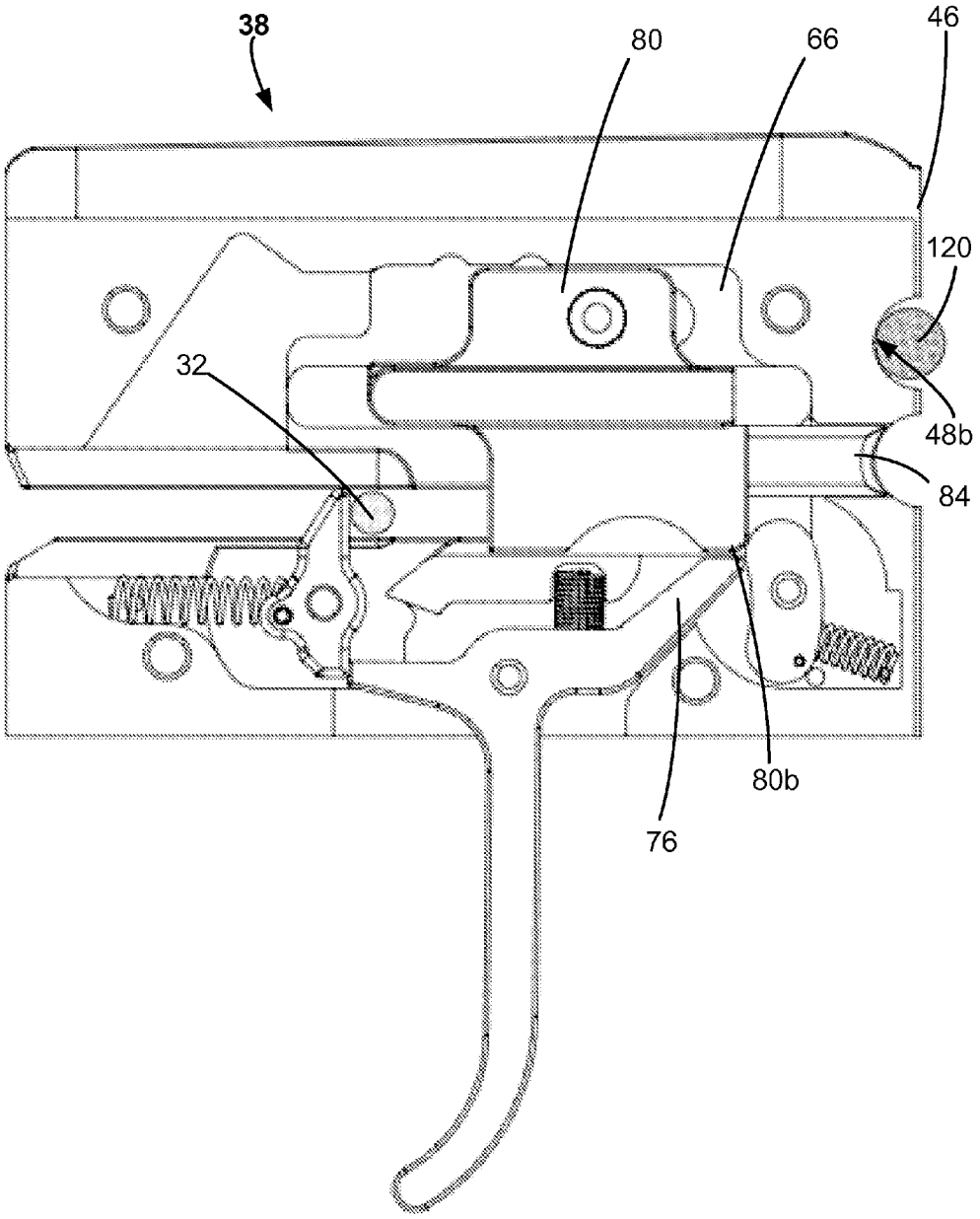
FIG. 12 is a partial sectional view of the embodiment of the trigger mechanism of FIG. 11, with a cocking rope in a disarm position.
Figure 13:
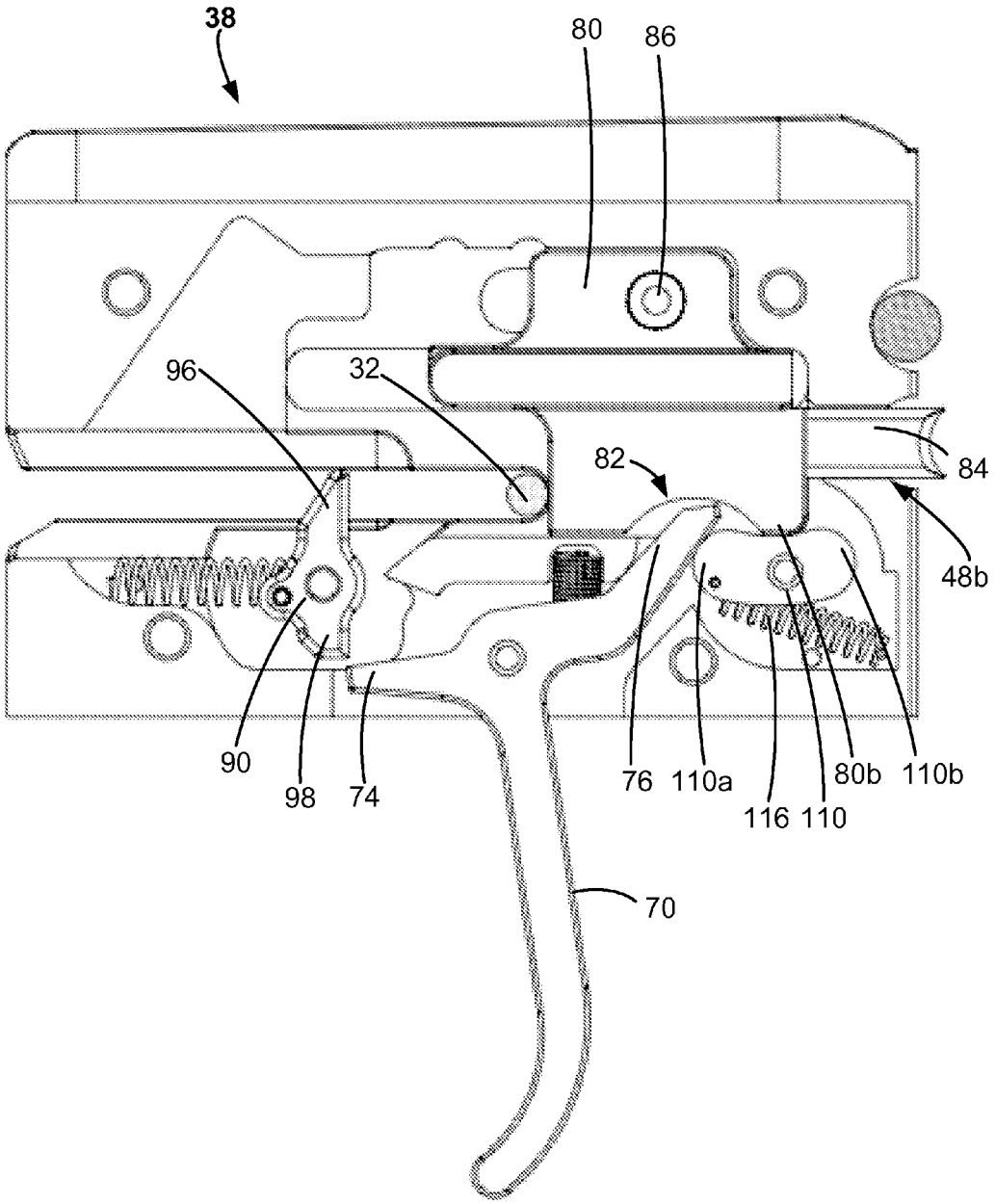
FIG. 13 is a partial sectional view of the trigger mechanism of FIG. 12, in a first position.
Figure 14:
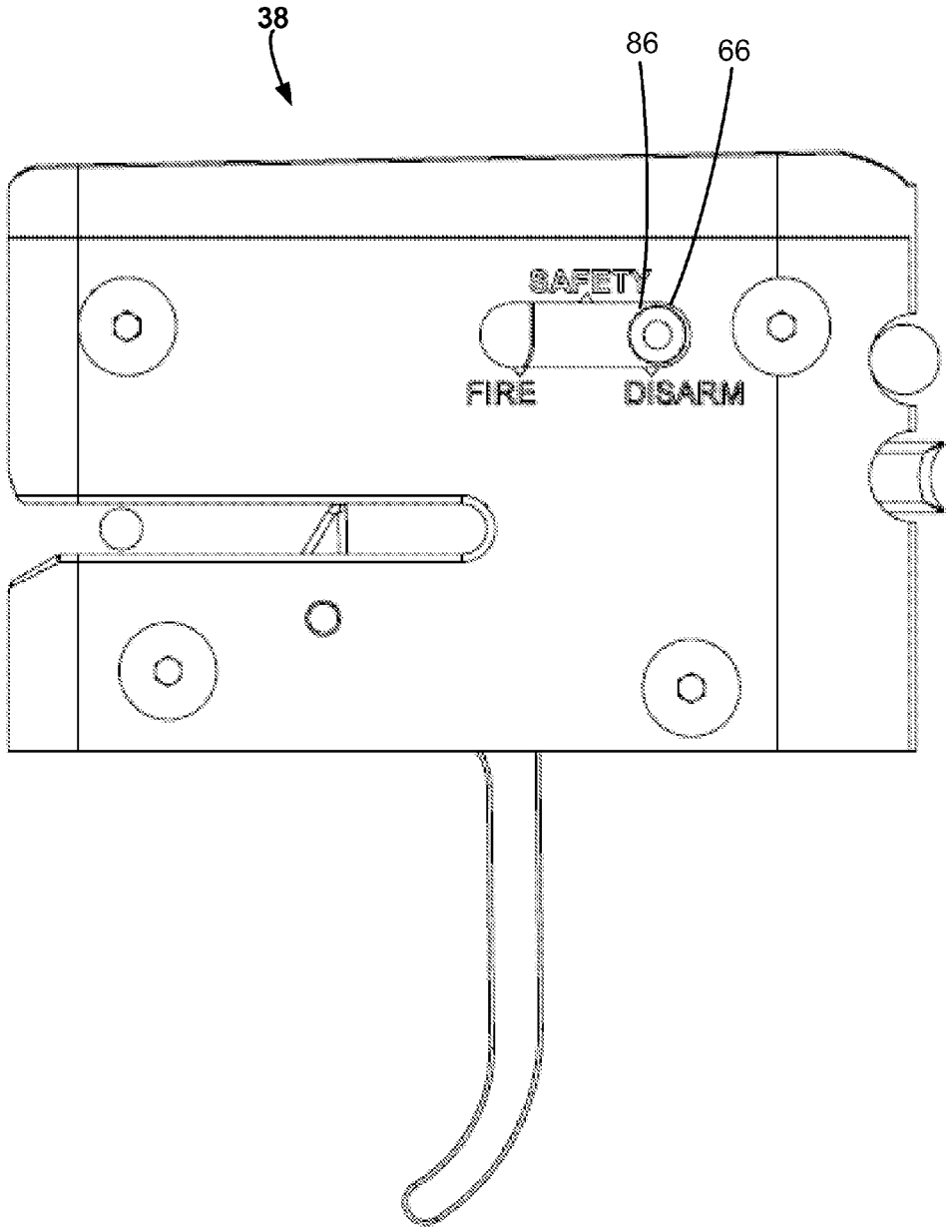
FIG. 14 is a front plan view of the embodiment of the trigger mechanism of FIG. 13, with the safety in a disarm position.

Referring to FIGS. 12-15, should the user wish to release the bowstring without firing or dry firing the crossbow 10, the user can use the trigger mechanism 38 shown in the figures to release the bowstring 32 without having to engage the trigger by the user's hand or finger. As shown in FIG. 12, the bowstring 32 is in the cocked position and the cocking rope 120 is placed in the housing second recess 48*b* so as to not exhibit force on the bolt 84. Referring to FIGS. 13 and 14, when the cocking rope 120, which is attached to the bowstring 32 at a second end (not shown), is pulled, the bowstring 32 pushes the sliding block 80 into the disarm position 66 (FIG. 14). As the sliding block 80 moves from the safety off or safety on position into the disarm position 66, the sliding block bottom surface 80*b* abuts against the lever second end 110*b* causing the lever 110 to rotate in the clockwise direction (with respect to FIG. 13) against the tension force of the tension spring 116. As the lever 110 rotates in the clockwise direction, the lever first end 110*a* exerts force against the trigger second arm 76 pushing the trigger second arm 76 into the sliding block recess 82, thereby causing the trigger lever 70 to rotate in the counterclockwise direction. It should be understood that the trigger lever 70 rotates without the user depressing the trigger since interaction of the sliding block 80 and the lever 110 causes the trigger lever to automatically rotate. As the trigger lever 70 rotates in the counterclockwise direction, the trigger first arm 74 no longer prevents the bowstring catch 90 from rotating in the counterclockwise direction since the trigger first arm 74 is no longer abutting against the bowstring catch second end 98.

Figure 15:
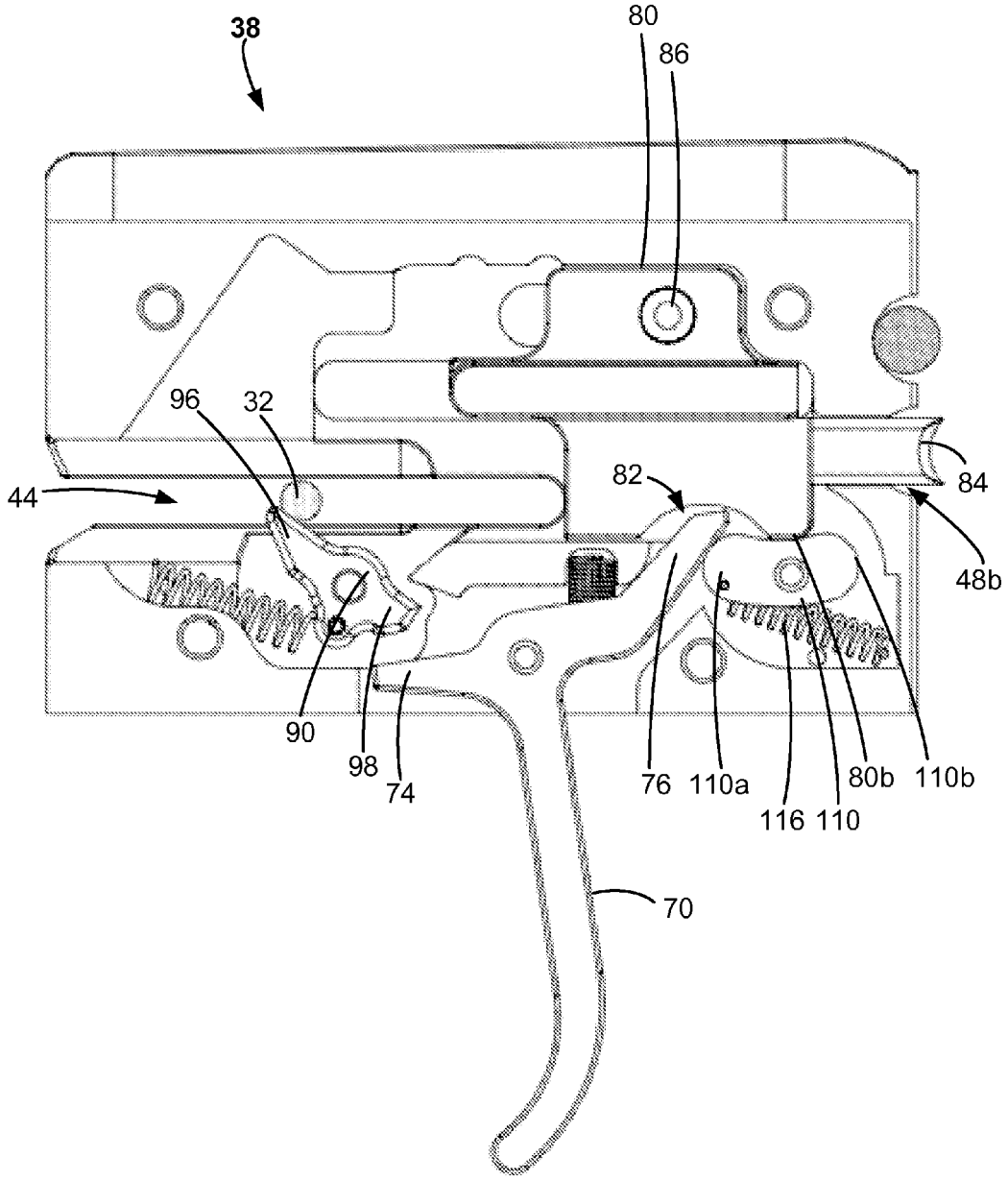
FIG. 15 is a partial sectional view of the trigger mechanism of FIG. 12, in a second position.
Figure 16:
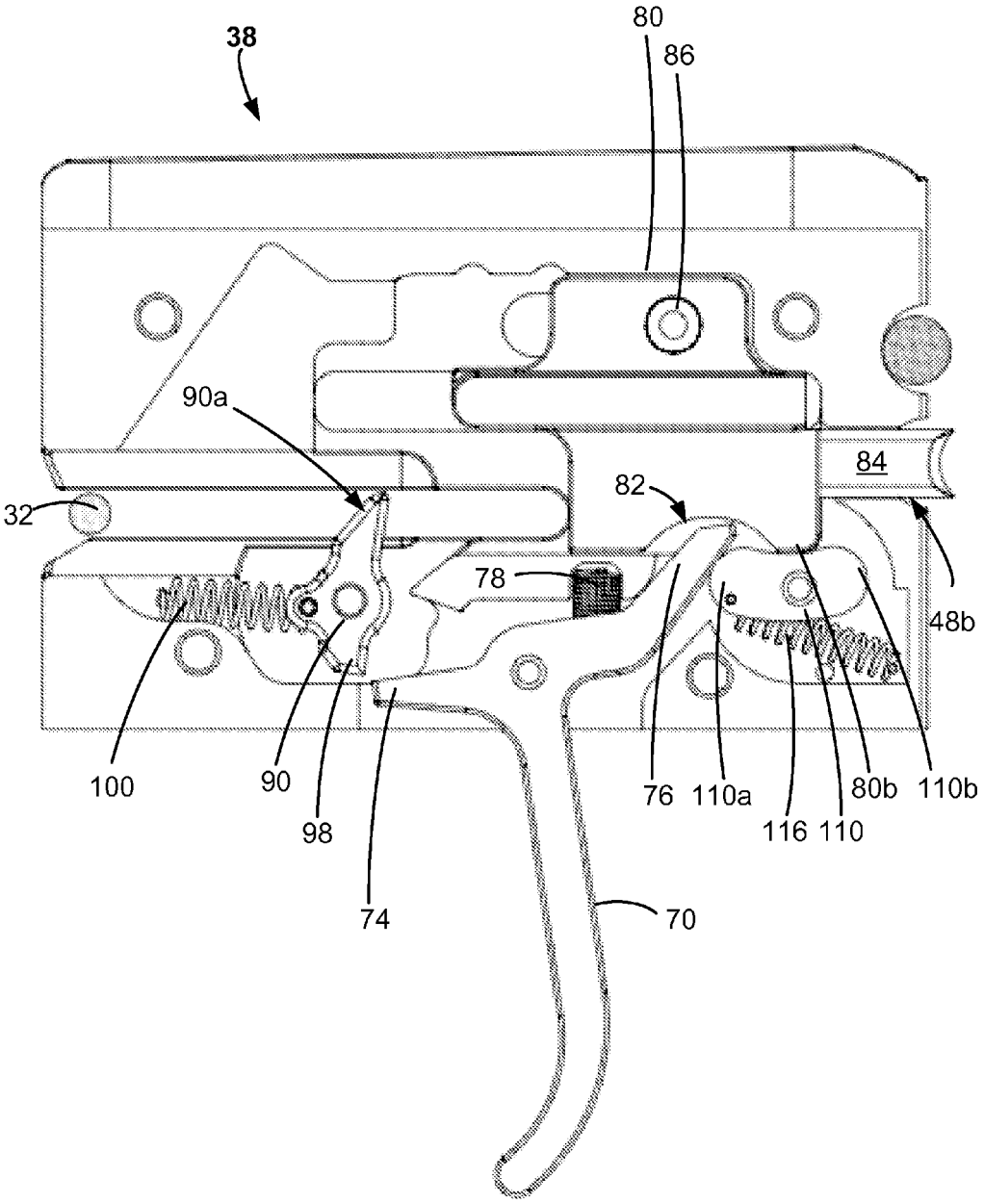
FIG. 16 is a partial sectional view of the trigger mechanism of FIG. 12, in a third position.

Referring to FIG. 15, because the bowstring catch 90 is able to rotate in the counterclockwise direction, the bowstring 32 may be slowly released out of the 44 using the cocking rope, exerting force on the bowstring catch second end 96 causing the bowstring catch 90 to rotate in the counterclockwise direction. This allows the bowstring 32 to pass over the bowstring catch 90. As shown in FIG. 16, once the bowstring 32 has passed the bowstring catch 90, the first spring 100 exerts force on the bowstring catch 90, causing the bowstring catch 90 to rotate clockwise and return to the upright position 90*a*.

Once the bowstring 32 is released, the user may move the sliding block 80 back into the safety on position 64 using the sliding block pins 86 and 88. That is, as the sliding block 80 is moved into the safety on position 64, the sliding block bottom surface 80*b* moves out of contact with the lever second end 110*b* thereby allowing the lever to rotate counter clockwise under the bias of tension spring 116. As the lever first end disengages from the trigger second arm 76, the trigger begins to rotate clockwise under the bias of spring 78. The lever will continue to rotate clockwise until the lever first arm 74 engages with the catch second end 98, as shown in FIG. 8.

Alternative Embodiment of Trigger Mechanism Having Disarm Mechanism

Figure 17:
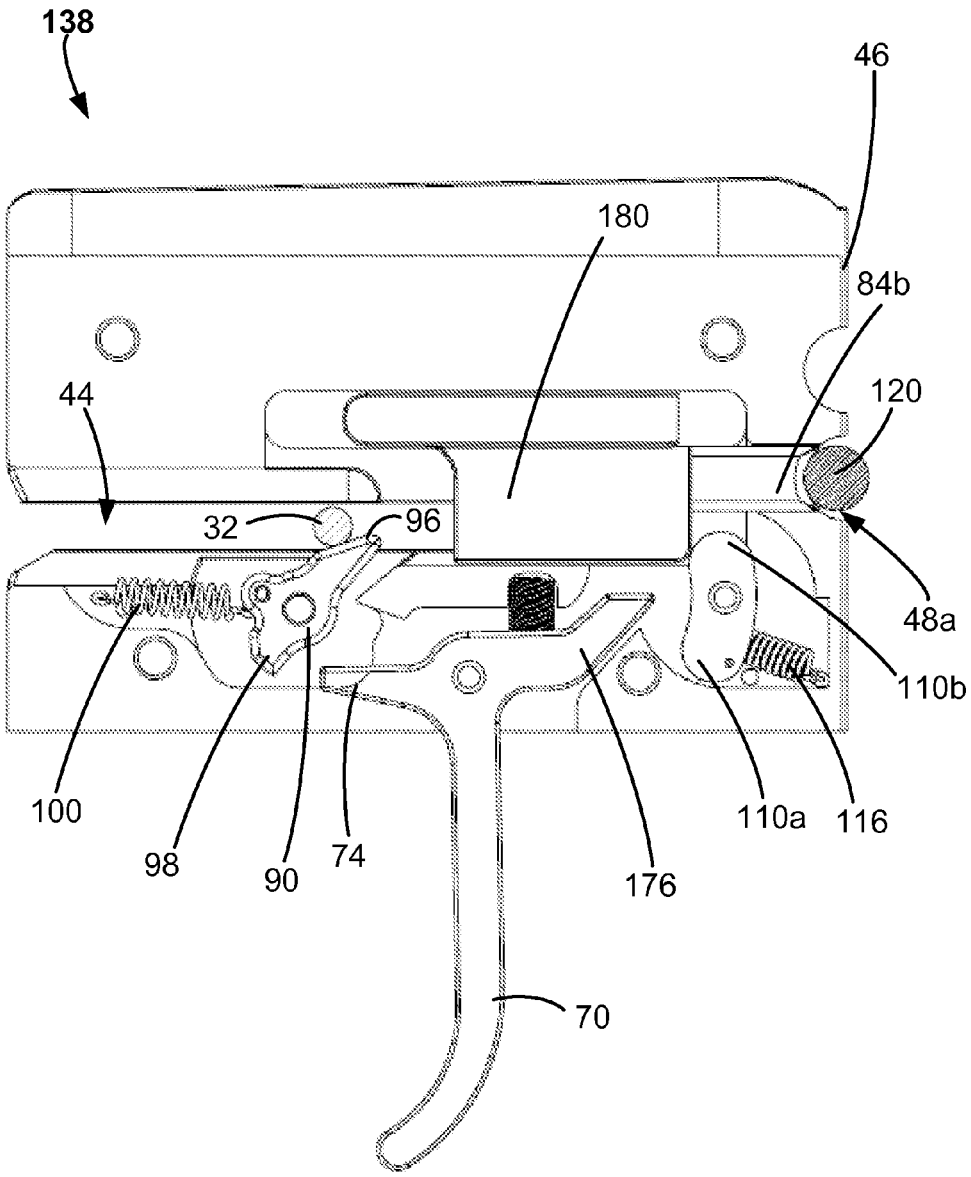
FIG. 17 is a partial sectional view of an alternate embodiment of a trigger mechanism for use in the crossbow of FIG. 1, in a first position and with a cocking rope in a cocking position.

FIGS. 17-21 illustrate an alternative embodiment of the trigger mechanism 138 where the disarm mechanism and the safety mechanism are separate and not integrated into a single unit. Because the trigger mechanism 138 of FIGS. 17-21 is similar to that of FIGS. 1-16, like numbers are used for like parts and modified or different parts use different numbers for ease of illustration. Referring to FIG. 17, the sliding block 180 does not contain a recess 82 as in the sliding block 80 of FIG. 3. Moreover, the trigger second arm 176 is shorter in length as compared to the trigger second arm 76 in FIG. 3. Otherwise, the trigger mechanism 138 of FIGS. 17-21 is similar to the trigger mechanism 38 of FIGS. 2-16.

Referring in particular to FIG. 17, the trigger mechanism 138 is shown with the housing first portion 40*a* removed. In the present configuration, the cocking rope 120 is engaged in the housing first recess 48*a*. Because the cocking rope 120 abuts against the bolt second end 84*b*, the sliding block 180 is prevented from moving into the disarm position. The bowstring 32 is shown positioned against the bowstring catch first end 96 causing the bowstring catch 90 to rotate clockwise allowing the bowstring 32 to pass over the bowstring catch 90. The sliding block 80 is maintained in the firing position and cannot move into the disarm position since the cocking rope 120 abuts the bolt first end 84*b*.

Figure 18:
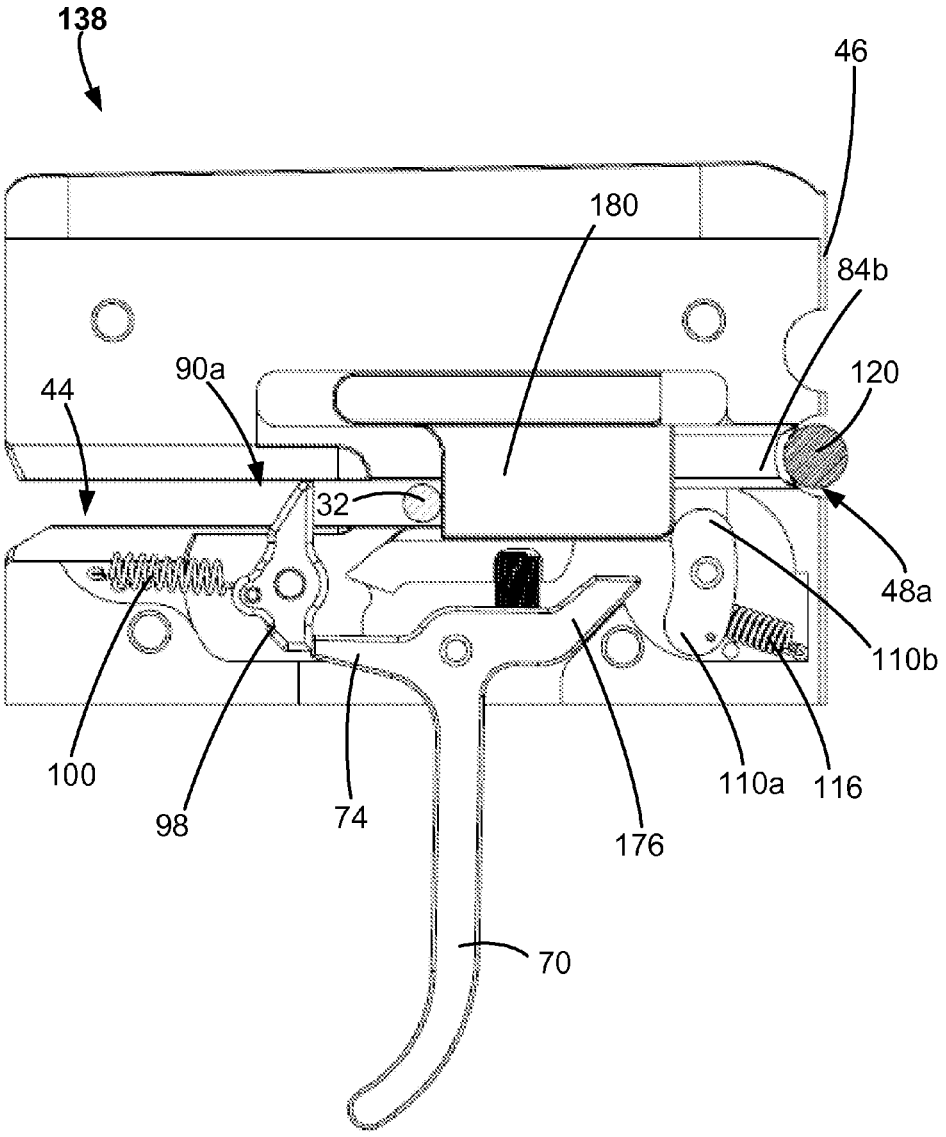
FIG. 18 is a partial sectional view of the trigger mechanism of FIG. 17, in a second position.
Figure 19:
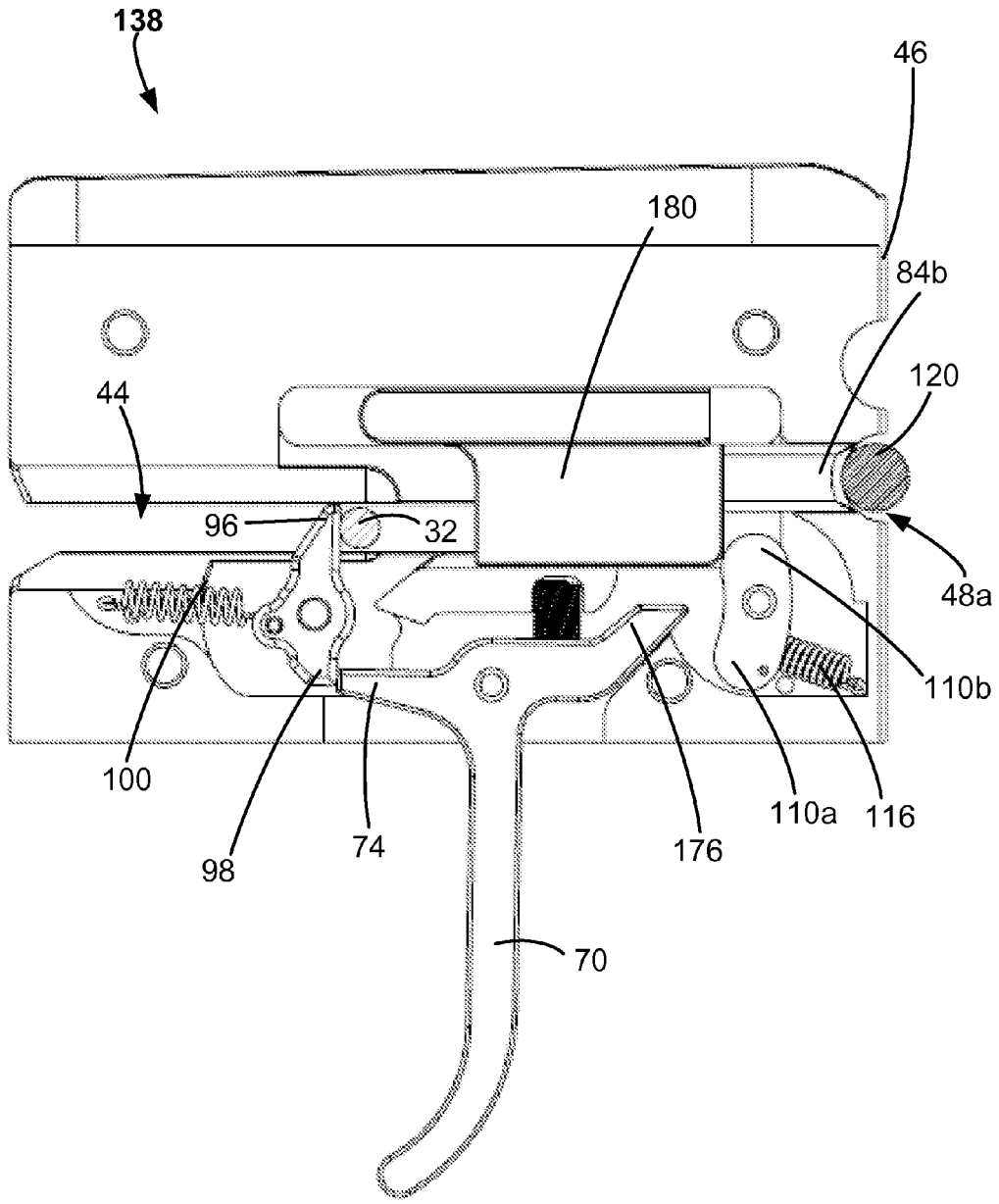
FIG. 19 is a partial sectional view of the trigger mechanism of FIG. 17, in a third position.

Referring to FIGS. 18 and 19, once the bowstring 32 passes the bowstring catch 90, the first spring 100 causes the bowstring catch 90 to rotate in the counterclockwise direction until the trigger first arm 74 abuts against the bowstring catch second end 98, preventing further rotation of the bowstring catch 90. This causes the bowstring catch 90 to be in an upright position 90*a* (FIG. 18) such that the bowstring catch first end 96 is located above and substantially in line with the bowstring catch second end 98. Referring to FIG. 19, with the bowstring catch 90 in the upright position 90*a*, the bowstring catch first end 96 prevents the bowstring 32 from sliding out of the slot 44.

Figure 20:
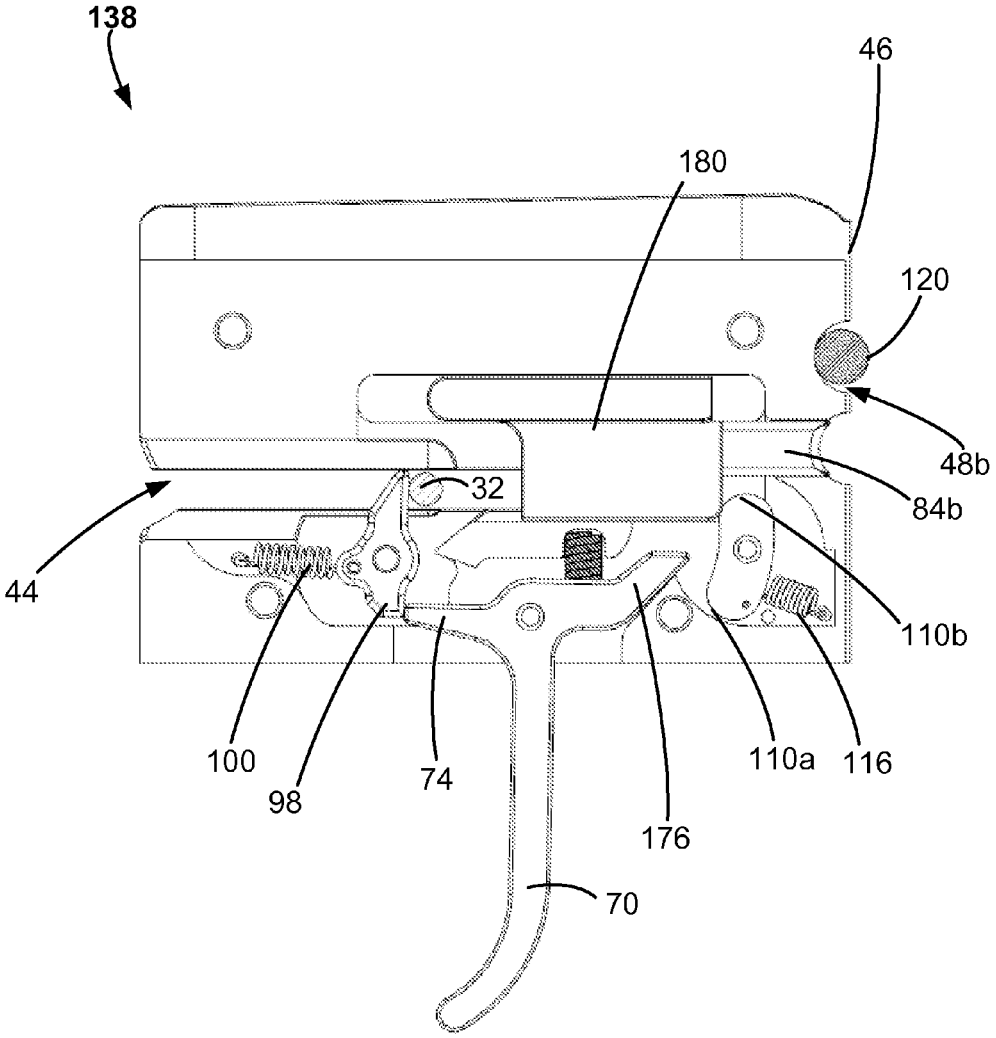
FIG. 20 is a partial sectional view of the embodiment of the trigger mechanism of FIG. 17, in a first position and with a cocking rope in a disarm position.
Figure 21:
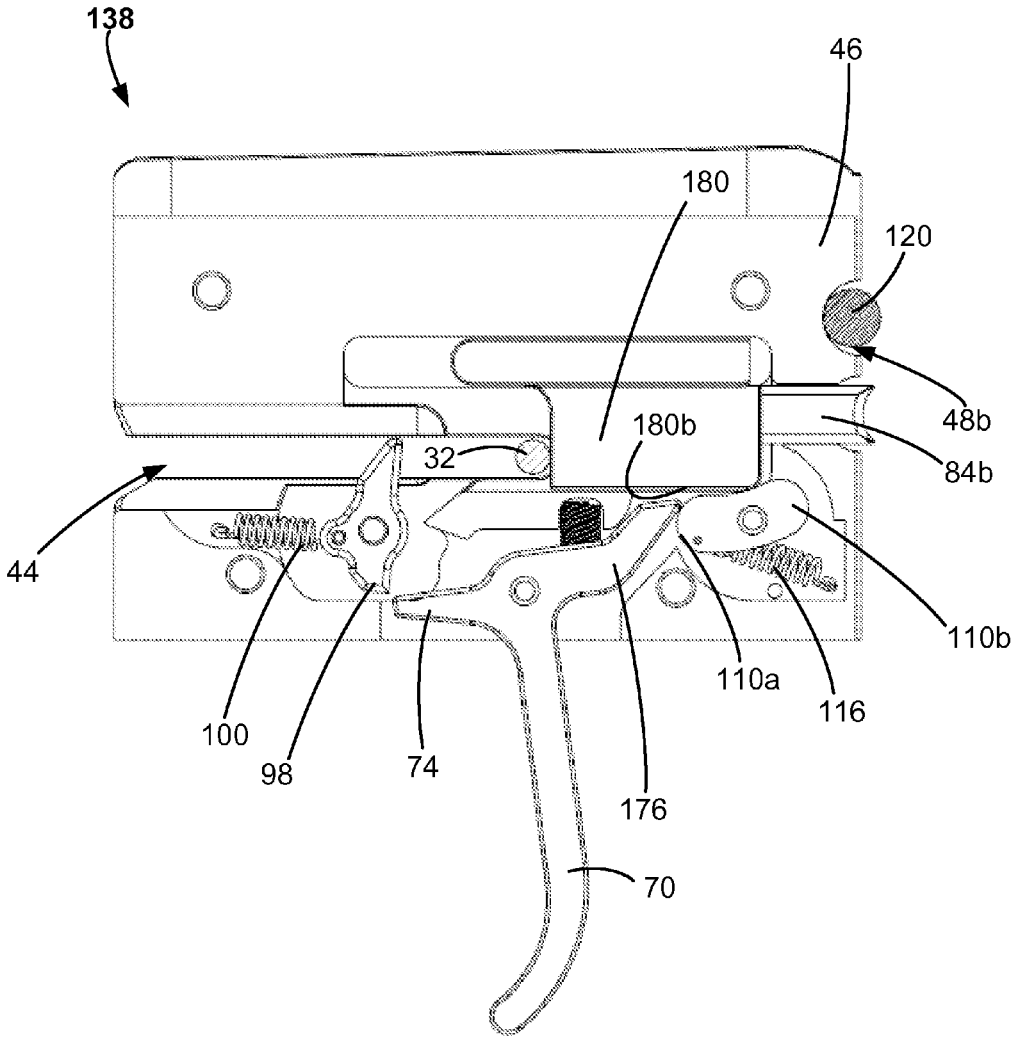
FIG. 21 is a partial sectional view of the embodiment of the trigger mechanism of FIG. 20, in a second position.
Figure 22:
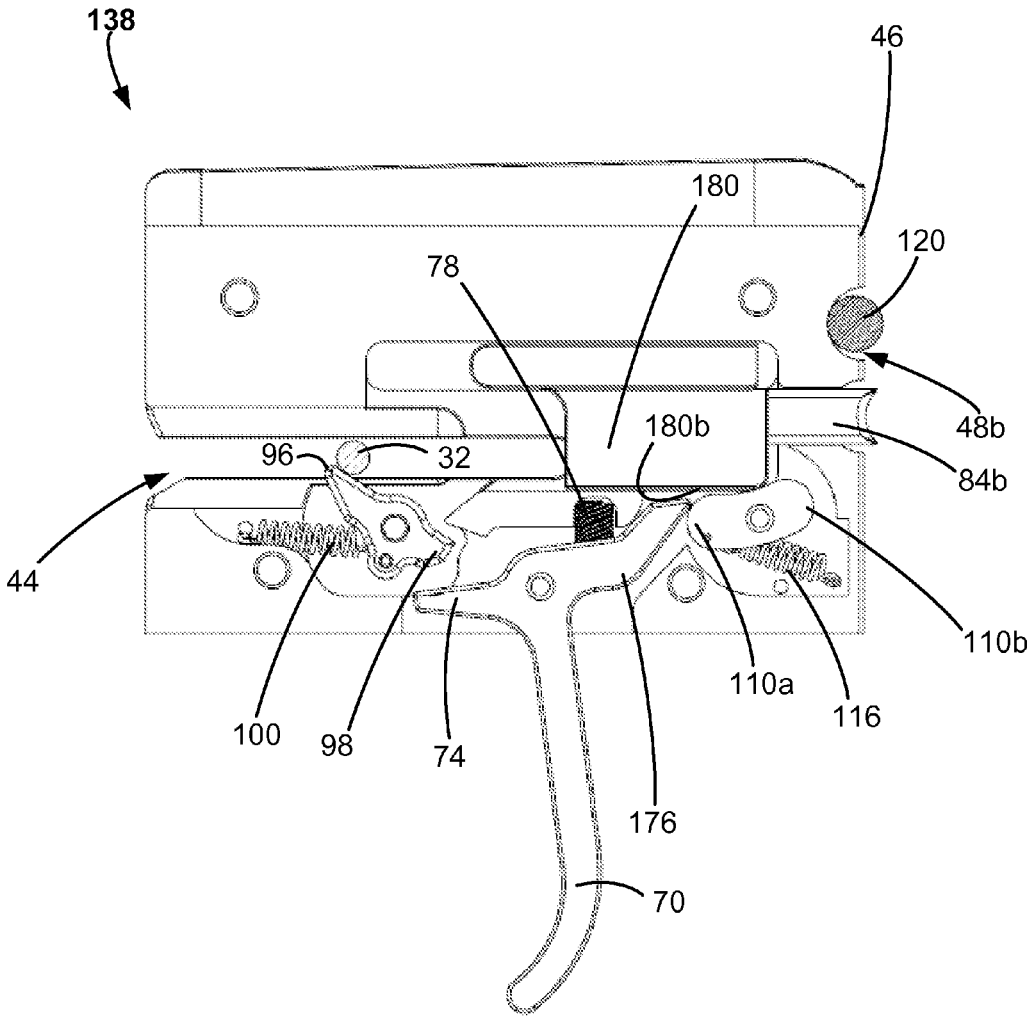
FIG. 22 is a partial sectional view of the embodiment of the trigger mechanism of FIG. 20, in a third position.

Referring to FIGS. 20-22, should the user wish to release the bowstring without firing or dry firing the crossbow 10, the user can use the trigger mechanism 138 shown in the figures to release the bowstring 32 without having to engage the trigger by the user's hand or finger. As shown in FIG. 20, the bowstring 32 is in the cocked position and the cocking rope 120 is placed in the housing second recess 48*b* so as to not exhibit force on the bolt 84. Referring to FIGS. 21 and 22, when the cocking rope 120, which is attached to the bowstring 32 at a second end (not shown), is pulled, the bowstring 32 pushes the sliding block 180 into the disarm position. As the sliding block 180 moves from the firing position into the disarm position 66, the sliding block bottom surface 180*b* abuts against the lever second end 110*b* causing the lever 110 to rotate in the clockwise direction (with respect to FIG. 21) against the tension force of the tension spring 116. As the lever 110 rotates in the clockwise direction, the lever first end 110*a* exerts force against the trigger second arm 176 pushing the trigger second arm 176 causing the trigger lever 70 to rotate in the counterclockwise direction. It should be understood that the trigger lever 70 rotates without the user depressing the trigger since interaction of the sliding block 180 and the lever 110 causes the trigger lever to automatically rotate. As the trigger lever 70 rotates in the counterclockwise direction, the trigger first arm 74 no longer prevents the bowstring catch 90 from rotating in the counterclockwise direction since the trigger first arm 74 is no longer abutting against the bowstring catch second end 98.

Referring to FIG. 22, because the bowstring catch 90 is able to rotate in the counterclockwise direction, the bowstring 32 may be slowly released out of the 44 using the cocking rope 120, exerting force on the bowstring catch second end 96 causing the bowstring catch 90 to rotate in the counterclockwise direction. This allows the bowstring 32 to pass over the bowstring catch 90.

Once the bowstring 32 is released, the sliding block 180 is moved back into the firing position since the lever 110 is biased counterclockwise by the second spring 116. Moreover, as the lever first end 110*a* disengages from the trigger second arm 176, the trigger begins to rotate clockwise under the bias of spring 78. The lever continues to rotate clockwise until the lever first arm 74 engages with the catch second end 98.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations as confirmed by the various embodiments disclosed herein. Therefore, it is to be understood that the invention is not to be limited to the specific embodiments disclosed and that the modifications and other embodiments are intended to be included within the scope of the appended exemplary concepts. Although specific terms are employed herein, they are used in a generic and descriptive sense only and not for the purposes of limitation.

What is claimed:

1. A trigger mechanism comprising:

a. a housing comprising:
   i. at least one cavity therein;
   ii. a first slot formed through a first side;
   iii. a first recess formed in a second side opposite the first side; and
   iv. a second recess formed in the second side opposite the first side;

b. a trigger lever at least partially received in the housing and pivotally mounted to the housing, the trigger lever comprising a trigger that partially extends out from the housing;

c. a bowstring catch pivotally mounted in the housing and operatively coupled to the trigger lever, wherein a portion of the bowstring catch extends into the housing first slot;

d. a disarm mechanism mounted in the housing and operatively coupled to the trigger lever;

e. the disarm mechanism comprises a sliding block having a recess formed in a first surface;

f. the trigger lever further comprises:
   a trigger first arm; and
   a trigger second arm:

g. the bowstring catch has a first end configured to retain a bowstring in the housing first slot when the trigger mechanism is coupled to a crossbow and the crossbow is in a cocked position and a second end that is configured to engage with the trigger first arm when the crossbow is in the cocked position; and h. the sliding block is moveable between:
   i. a safety on first position in which a portion of the sliding block first surface abuts the trigger lever second arm thereby preventing the trigger lever from rotating;
   ii. a safety off second position in which the portion of the sliding block first surface is moved out of engagement with the trigger second arm thereby allowing the trigger lever to rotate; and
   iii. a disarm third position in which the sliding block recess aligns with the trigger second arm and the trigger lever automatically rotates so that:
      the trigger second arm is partially received in the sliding block recess; and
      the trigger first arm disengages from the bowstring catch second end to allow the bowstring catch to rotate,
   wherein a portion of the disarm mechanism is moveable into and out of the housing first recess.

2. The trigger mechanism of claim 1, wherein when the trigger mechanism is inserted into a crossbow having a bowstring and when a cocking rope is inserted into the housing first recess in order to move the bowstring from a resting position into a cocked position, the cocking rope prevents the portion of the disarm mechanism from moving into the housing first recess thereby preventing the disarm mechanism from moving into a disarm position.

3. The trigger mechanism of claim 1, further comprising:

a. a lever having a first end and a second end, wherein the lever is pivotally coupled to the housing; and b. a spring having a first end coupled to the housing and a second end coupled to the lever proximate the lever first end, wherein i. the spring biases an axis of the lever into a substantially perpendicular orientation with respect to the sliding block first surface when the lever is in a resting position; and ii. when the sliding block moves from one of the safety on first position or safety off second position into the disarm third position, the sliding block engages the lever second end causing the lever to rotate so that the lever first end engages the trigger lever second arm thereby causing the trigger lever to automatically rotate.

4. The trigger mechanism of claim 1, wherein:

a. the disarm mechanism further comprises a bolt having a first end operatively coupled to a second surface of the sliding block and a second end that is moveable into and out of the housing first recess; and b. when the trigger mechanism is inserted into a crossbow having a bowstring and when a cocking rope is inserted into the housing first recess in order to move the bowstring from a resting position into a cocked position, the bolt prevents the sliding block from moving into the disarm third position.

5. The trigger mechanism of claim 1, wherein when:

a. the trigger mechanism is inserted into a crossbow having a bowstring; and b. the bowstring is moved into and retained in the cocked position by the bowstring catch first end, the trigger mechanism is configured to:

i. allow the bowstring to be drawn farther into the housing first slot so that the bowstring pushes the sliding block from one of the safety on first position or the safety off second position into the disarm third position;

ii. cause the sliding block to engage the lever first end as the sliding block moves into the disarm third position; and iii. cause the lever to rotate so that the lever second end engages the trigger second arm thereby automatically:

causing the trigger lever to rotate such that a portion of the trigger second arm is received in the sliding block recess; and causing the trigger first arm to disengage from the bowstring catch second end allowing the user to controllably release the bowstring from the cocked position into a resting position.

6. The trigger mechanism of claim 1, wherein when the sliding block is moved into the disarm third position:

a. the sliding block engages the lever first end causing the lever to rotate against the bias of the spring;

b. the lever second end engages the trigger second arm causing the trigger lever to rotate so that a portion of the trigger second arm is received in the sliding block recess; and c. the trigger first arm disengages from the bowstring catch second end thereby allowing the bowstring catch to rotate.

7. The trigger mechanism of claim 1, further comprising a spring having a first end operatively coupled to the housing and a second end operatively coupled to a portion of the trigger second arm, wherein the spring is configured to bias the trigger second arm so that the trigger first arm engages with the bowstring catch second end.

8. The trigger mechanism of claim 1, further comprising a spring having a first end operatively coupled to the housing and a second end operatively coupled to the bowstring catch so that the spring biases the bowstring catch second end out of engagement with the trigger first arm.

9. A crossbow and trigger mechanism comprising:

a. a body having a first end and a second end and an axis extending from the first end to the second end;

b. a first limb comprising a first end coupled to the body first end and a second end;

c. a second limb comprising a first end coupled to the body first end and a second end;

d. a bowstring having a bowstring first end coupled to the first limb second end and a bowstring second end coupled to the second limb second end; and e. a trigger mechanism operatively coupled to the body intermediate the body first end and the body second end, the trigger mechanism comprising:

i. a trigger lever pivotally coupled to the body, the trigger lever comprising:

a trigger that partially extends from the body;

a trigger first arm; and a trigger second arm;

ii. a sliding block that is slidably mounted at least partially within the body;

iii. a lever pivotally mounted at least partially in the body, the lever comprising a first end and a second end that is operatively coupled to the body by a spring and an axis that extends from the first end to the second end; and iv. a bowstring catch pivotally mounted at least partially in the body, the bowstring catch having a first end configured to retain the bowstring when the crossbow is in a cocked position and a second end that is configured to engage with the trigger first arm when the crossbow is in the cocked position, wherein when the sliding block is moved into a disarm position:

the sliding block engages the lever first end thereby causing the lever to rotate;

the lever second end engages the trigger second arm causing the trigger lever to rotate;

the trigger first arm moves out of engagement with the bowstring catch second end, thereby allowing the bowstring catch to rotate so that the bowstring can be released from the trigger mechanism without the user having to fire the crossbow wherein the sliding block further comprises a recess in a bottom surface, wherein when the sliding block is moved into the disarm position, the sliding block recess aligns with the trigger second arm such that a portion of the trigger second arm is received in the sliding block recess thereby allowing the trigger lever to rotate.

10. The crossbow and trigger mechanism of claim 9, further comprising a housing having a slot formed in one end and a recess formed in an opposite end, wherein a. the housing is partially mounted within the body;
b. the trigger lever is pivotally mounted in the housing so that the trigger extends partially out of the housing;
c. the sliding block is slidably mounted in the housing so that a portion of the sliding block extends into the housing recess;
d. the lever is pivotally mounted in the housing; and
e. the bowstring catch is pivotally mounted in the housing so that the bowstring catch first end traverses through the housing slot.

11. A crossbow and trigger mechanism comprising:
a. a body having a first end and a second end;
b. a first limb comprising a first end coupled to the body first end and a second end;
c. a second limb comprising a first end coupled to the body first end and a second end;
d. a bowstring having a bowstring first end coupled to the first limb second end and a bowstring second end coupled to the second limb second end; and
e. a trigger mechanism operatively coupled to the body intermediate the body first end and the body second end, the trigger mechanism comprising:
  i. a housing comprising:
    at least one cavity therein; and
    a first slot formed through a first side;
  ii. a trigger lever at least partially received in the housing and pivotally mounted to the housing, the trigger lever comprising a trigger that partially extends out from the housing;
  iii. a bowstring catch pivotally mounted in the housing and operatively coupled to the trigger lever, wherein a portion of the bowstring catch extends into the first slot; and
  iv. a disarm mechanism mounted in the housing and operatively coupled to the trigger mechanism,
f. the trigger lever further comprises:
  i. a trigger first arm; and
  ii. a trigger second arm;
g. the disarm mechanism further comprises:
  i. a sliding block at least partially received in the housing; and
  ii. a lever pivotally mounted in the housing; and
h. a spring having a first end coupled to the housing and a second end operatively coupled to one of:
  i. a portion of the trigger second arm, wherein the spring is configured to bias the trigger second arm so that the trigger first arm engages with the bowstring catch second end;
  ii. the lever proximate the lever first end, wherein the spring biases an axis of the lever into a substantially perpendicular orientation with respect to a first surface of the sliding block when the lever is in a resting position and when the sliding block moves from the first position into the disarm second position, a portion of the trigger second arm is received in a recess formed in the sliding block first surface, or
  iii. the bowstring catch so that the spring biases the bowstring catch second end out of engagement with the trigger first arm, wherein
  the disarm mechanism is configured so that when a cocking rope is used to move the bowstring into a cocked position, the cocking rope is operatively coupled to the disarm mechanism to prevent the disarm mechanism from moving into a disarm position,
  the bowstring catch comprises a first end configured to retain a bowstring in the housing slot when the crossbow is in a cocked position and a second end that is configured to engage with the trigger first arm when the crossbow is in the cocked position; and
  the sliding block is moveable between;
    a firing first position in which the trigger lever can rotate to disengage from the bowstring catch when a user depresses the trigger; and
    a disarm second position in which:
      the portion of the disarm mechanism is positioned within the housing first recess; and
      the sliding block engages a first end of the lever causing a second end of the lever to engage with the trigger second arm so that the trigger lever automatically rotates causing the trigger first arm to disengage from the bowstring catch second end.

12. The crossbow and trigger mechanism of claim 11, further comprising a catch coupled to the body, wherein the catch is operatively coupled to the disarm mechanism so that when the cocking rope is coupled to the catch and is used to move the bowstring into a cocked position, the catch prevents the disarm mechanism from moving into the disarm position.

13. The crossbow and trigger mechanism of claim 11, wherein
a. the housing further comprises:
  i. a first recess formed in a second side opposite the first side; and
  ii. a second recess formed in the second side opposite the first side; and
b. a portion of the disarm mechanism is moveable into and out of the housing first recess.

14. The crossbow and trigger mechanism of claim 13, wherein, when the cocking rope is used to move the bowstring into the cocked position, the second recess is configured to receive a portion of the cocking rope so that the cocking rope prevents the disarm mechanism from moving into the second recess when the crossbow is cocked.

15. The crossbow and trigger mechanism of claim 11, wherein the portion of the disarm mechanism that is moveable into and out of the housing first recess comprises a bolt having a first end operatively coupled to a second surface of the sliding block and a second end that is moveable within the housing first recess, wherein when a cocking rope is inserted into the housing first recess in order to move the bowstring from a resting position into a cocked position, the bolt prevents the sliding block from moving into the disarm second position.

16. The crossbow and trigger mechanism of claim 11, wherein
a. the sliding block further comprises a recess formed in the first surface; and
b. when the bowstring is moved into and retained in the cocked position by the bowstring catch first end, the trigger mechanism is configured to:
  i. allow the bowstring to be drawn further into the housing slot so that the bowstring pushes the sliding block from the firing first position into the disarm second position;
  ii. cause the sliding block to engage the lever first end as the sliding block moves into the disarm second position; and
  iii. cause the lever to rotate so that the lever second end engages the trigger second arm automatically causing:

the trigger lever to rotate such that a portion of the trigger second arm is received in the sliding block recess; and the trigger first arm to disengage from the bowstring catch second end to allow the user to controllably release the bowstring from the cocked position into a resting position.

17. The crossbow and trigger mechanism of claim 11, wherein when the sliding block is moved into the disarm second position:

a. the sliding block engages the lever first end causing the lever to rotate against the bias of the spring;

b. the lever second end engages the trigger second arm causing the trigger lever to rotate so that a portion of the trigger second arm is received in the sliding block recess; and c. the trigger first arm disengages from the bowstring catch second end thereby allowing the bowstring catch to rotate.

18. The crossbow and trigger mechanism of claim 11, wherein the sliding block is movable into a safety on third position in which a portion of the sliding block first surface abuts the trigger lever second arm thereby preventing the trigger lever from rotating.

19. A trigger mechanism comprising:

a. a housing comprising a first side defining a slot there through;

b. a trigger lever at least partially received in the housing and pivotally mounted to the housing, the trigger lever comprising:

a trigger that partially extends from the housing;

a trigger first arm; and a trigger second arm;

c. a sliding block that is slidably received in the housing;

d. a lever that is pivotally mounted in the housing, the lever having a first end and a second end; and e. a bowstring catch pivotally mounted in the housing, the bowstring catch having a first end configured to retain a bowstring in the housing slot when the trigger mechanism is coupled to a crossbow and the crossbow is in a cocked position and a second end that is configured to engage with the trigger first arm when the crossbow is in the cocked position, wherein when the sliding block is moved into a disarm position:

the sliding block engages the lever first end thereby causing the lever to rotate;

the lever second end engages the trigger second arm causing the trigger lever to rotate; and the trigger first arm moves out of engagement with the bowstring catch second end, thereby allowing the bowstring catch to rotate so that the bowstring can be released from the trigger mechanism without the user having to fire the crossbow;

the sliding block further comprises a recess formed in a first surface of the sliding block; and when the sliding block is moved into the disarm position, a portion of the trigger second arm is received in the sliding block recess.

20. The trigger mechanism of claim 19, wherein when the sliding block is moved into a safety on position, a portion of the sliding block first surface aligns with the trigger second arm thereby preventing the trigger lever from rotating.

* * * * *